US005558318A

United States Patent [19]

Crowley et al.

[11] Patent Number: 5,558,318

[45] Date of Patent: Sep. 24, 1996

[54] SEPARATOR FOR FORMING DISCRETE STACKS OF FOLDED WEB

[75] Inventors: H. W. Crowley, Newton; Stephen E. Silva, Acton; Peter E. Bianchetto, Foxboro; John W. Clifford, Ashland, all of Mass.; Bruce J. Taylor, Manchester, N.H.

[73] Assignee: Roll Systems, Inc., Burlington, Mass.

[21] Appl. No.: 219,503

[22] Filed: Mar. 29, 1994

Related U.S. Application Data

[63] Continuation-in-part of Ser. No. 943,446, Sep. 10, 1992, Pat. No. 5,360,213, which is a continuation of Ser. No. 641,472, Jan. 15, 1991, Pat. No. 5,149,075.

[51] Int. Cl.[6] ..... B65B 35/50; B65G 57/00; B65H 29/00

[52] U.S. Cl. ..... 270/39.05; 414/21; 414/788.3; 414/791.2; 414/794.7; 414/907; 414/923; 414/924; 414/925; 493/412; 493/415

[58] Field of Search ..... 270/39; 493/357, 493/358, 412, 416, 436, 448, 411, 413, 414, 415; 414/21, 788.3, 791.2, 907, 794.7, 923, 924, 925, 926

[56] References Cited

U.S. PATENT DOCUMENTS

| | | |
|---|---|---|
| 992,473 | 5/1911 | Barber . |
| 1,024,459 | 4/1912 | Seymour . |
| 1,858,073 | 5/1932 | Cole . |
| 2,214,593 | 9/1940 | Mustin et al. . |
| 2,675,747 | 4/1954 | Greiner et al. . |
| 2,936,815 | 5/1960 | Schjeldahl et al. . |
| 3,048,389 | 8/1962 | Salmon et al. . |
| 3,086,768 | 4/1963 | Lach . |
| 3,301,111 | 1/1967 | Nystrand . |
| 3,589,709 | 6/1971 | Hey et al. . |
| 3,627,304 | 12/1971 | Reeder et al. . |
| 3,640,521 | 2/1972 | Hutley . |
| 3,684,275 | 8/1972 | Schweitzer et al. . |
| 3,724,838 | 4/1973 | Orlovsky . |
| 3,744,362 | 7/1973 | Gesell et al. . |
| 3,746,142 | 7/1973 | Hepp et al. . |
| 3,820,700 | 6/1974 | Quirijnen . |
| 3,858,476 | 1/1975 | DeLigt . |
| 3,883,131 | 5/1975 | Anderson, Jr. et al. ..... 493/416 X |
| 3,889,940 | 6/1975 | Jakob . |
| 3,897,051 | 7/1975 | Muller . |
| 3,913,904 | 10/1975 | Occhetti . |
| 3,961,781 | 6/1976 | Funk . |

(List continued on next page.)

FOREIGN PATENT DOCUMENTS

| | | |
|---|---|---|
| 2506901 | 8/1975 | Germany . |
| 60-56773 | 4/1985 | Japan . |
| 60-102367 | 6/1985 | Japan . |
| 60-171969 | 9/1985 | Japan . |
| 63-112369 | 5/1988 | Japan . |
| 988080 | 4/1965 | United Kingdom . |
| WO88/03121 | 5/1988 | WIPO . |
| WO88/03509 | 5/1988 | WIPO . |

*Primary Examiner*—John E. Ryznic
*Attorney, Agent, or Firm*—Cesari and McKenna

[57] ABSTRACT

A system for conveying folded web and forming discrete stacks of folded web comprising a conveyor that receives a stack of folded output web from a web folder and separator. The conveyor drives the web from an upstream end, adjacent the web folder and separator, to a downstream end. A supporting surface, which can comprise a plurality of pivoting rails biased by a spring, selectively supports the web remote from and off of the conveyor so that a compressed stack can be formed adjacent the folder and separator. At selected times, the stack is moved by the supporting surface into communication with the folder and separator so that it can be conveyed downstream. An elevator platform can be located at the downstream location for receiving successive stacks thereon. The elevator ascends and descends so that the tops of the successive stacks are aligned with the conveyor for receipt of a further stack thereon. The elevator platform can include a drive that enables it to rotate so that successive stacks are deposited on the elevator platform in a rotationally offset orientation relative to each other.

51 Claims, 19 Drawing Sheets

U.S. PATENT DOCUMENTS 3,991,993 11/1976 Clouthier .
4,045,012 8/1977 Jakob .
4,068,566 1/1978 Joice .
4,118,022 10/1978 Rayfield et al. .
4,134,559 1/1979 Dyllus et al. .
4,190,242 2/1980 Bolza-Schunemann .
4,205,836 6/1980 Nystrand .
4,216,705 8/1980 Achelpohl et al. .
4,223,882 9/1980 Stocker .
4,261,497 4/1981 Roetter et al. .
4,269,401 5/1981 Sargis et al. .
4,296,684 10/1981 Wangermann .
4,358,285 11/1982 Fujino ..... 493/411
4,401,428 8/1983 Thomas et al. .
4,406,650 9/1983 Felix .
4,412,637 11/1983 Berger .
4,460,350 7/1984 Mittal et al. .
4,487,645 12/1984 Weston .
4,507,109 3/1985 Meschi .
4,508,527 4/1985 Uno et al. .
4,573,409 3/1986 Clar et al. .
4,573,670 3/1986 Felix .
4,573,958 3/1986 Biesinger ..... 493/414 X
4,577,789 3/1986 Hofmann et al. .
4,578,052 3/1986 Engel et al. .
4,593,893 6/1986 Suter .
4,610,649 9/1986 Friess .
4,611,799 9/1986 Nuttin .
4,618,340 10/1986 Meschi .
4,623,136 11/1986 Bunch, Jr. .
4,650,447 3/1987 Meschi .
4,657,465 4/1987 Aoki ..... 414/788.3
4,673,382 6/1987 Buck et al. .
4,688,708 8/1987 Irvine et al. .
4,702,135 10/1987 Kwasnitza .
4,708,332 11/1987 Besemann .
4,718,654 1/1988 Ehlers .
4,721,295 1/1988 Hathaway .
4,725,051 2/1988 Parr .
4,729,812 3/1988 Meschi .
4,730,762 3/1988 Felix .
4,751,879 6/1988 Van Pelt .
4,781,090 11/1988 Feldkamper et al. .
4,824,426 4/1989 DuFresne .
4,828,540 5/1989 Fordyce .
4,842,572 6/1989 Roth .
4,842,573 6/1989 Peter et al. ..... 493/412
4,846,454 7/1989 Parkander .
4,861,327 8/1989 Hanyu et al. .
4,871,157 10/1989 Hermann et al. .
4,917,657 4/1990 Bunch, Jr. .
4,928,940 5/1990 Dash .
5,002,456 3/1991 Gosslinghoff ..... 414/788.3
5,015,222 5/1991 Bunch, III .
5,030,192 7/1991 Sager .
5,049,121 9/1991 Bunch, III .
5,064,179 11/1991 Martin ..... 493/414 X
5,065,992 11/1991 Crowley .
5,085,624 2/1992 Felix ..... 493/413
5,087,023 2/1992 Gilbert et al. .
5,090,678 2/1992 Green ..... 270/39 X
5,110,101 5/1992 Roth ..... 270/39
5,131,640 7/1992 Crowley .
5,149,075 9/1992 Crowley et al. ..... 270/39
5,273,516 12/1993 Crowley ..... 493/416
5,279,536 1/1994 Abreu ..... 270/39 X
5,299,793 4/1994 Couturier ..... 270/39
5,360,213 11/1994 Crowley et al. ..... 270/39
5,3553,576 10/1994 Palamides et al. ..... 414/791.2 X

SEPARATOR FOR FORMING DISCRETE STACKS OF FOLDED WEB

RELATED APPLICATION

This application is a continuation-in-part of U.S. patent application Ser. No. 07/943,446, filed Sep. 10, 1992, now U.S. Pat. No. 5,360,213, which is itself a continuation of U.S. patent application Ser. No. 07/641,472, now U.S. Pat. No. 5,149,075.

FIELD OF THE INVENTION

This invention relates to a conveying system that enables the formation of discrete stacks of folded web output from a web separator and that allows such stacks to be combined in an offset relationship.

BACKGROUND OF THE INVENTION

It is desirable to separate the output of a zig-zag folded stack of sheets into discrete stacks. As such, different printing jobs can be identified and unloaded individually. This is particularly desirable where different jobs are automatically routed from a separator to different locations. By separating the jobs, routing is made easier.

In a folder and separator such as that disclosed in Applicant's U.S. Pat. No. 5,149,075, a conveyor table is used to direct output away from the separator unit to a remote location. Users may require separated stacks to be routed to remote locations. Thus, modification of the conveyor table provides one possible mechanism for forming discrete stacks of folded web that can be routed to different locations.

It is, therefore, an object of this invention to provide a conveyor that forms discrete folded stacks of web output from a separator. It is another object of this invention to form more compact stacks of web that are free of airspace between pages, and also to form offset groups of stacks for easy sorting. It is yet another object of the invention to provide a conveyor that can be used in combination with existing web folders and separators.

SUMMARY OF THE INVENTION

This invention provides a system for conveying folded web and for forming discrete stacks of folded web. The system includes a conveyor that receives a stack of output folded web from a web folder and separator. The conveyor drives the web from an upstream end, adjacent the web folder and separator, to a downstream end. The conveyor can comprise a conveyor table that is free-standing and constructed as a part of the folder and separator. The conveyor includes a supporting surface, adjacent the web folder and separator, that supports a web exiting the web folder and separator at a location remote from the conveyor for selected period of time so that a selected volume of web is formed on the supporting surface free of contact with the conveyor. The supporting surface can include a drive member that biases the supporting surface between the position remote from the conveyor and another position close to the conveyor, wherein web can be conveyed to the downstream position.

In one embodiment, the supporting surface can include drive member that comprises a spring for biasing the supporting surface to the position remote from the conveyor. In this embodiment, supporting surface can comprise one or more rails mounted on a pivot and located in cut-outs in the conveyor table. When a predetermined volume of folded and compressed web is formed on the supporting surface, the weight of the stack of folded web causes the folded web to be moved onto the conveyor.

According to another embodiment, the conveyor can include, at the downstream location, an elevator platform that receives folded web. Upstream of the elevator platform can be located a sensor, that causes the platform to descend in response to passage of web therethrough. The descending elevator platform enables the formation of large stacks while a top of a stack is maintained in approximate alignment with the conveyor table surface. The conveyor can further include a retracting pressure mechanism, that in response to passage of web through the sensor, retracts and biases the upstream, trailing end of the stack onto the elevator platform.

According to a further embodiment, the elevator platform can include a turntable drive that enables rotation of the elevator platform to selected rotation orientations. Hence, the elevator platform can be rotated to enable further folded stacks of web to be rotated relative to preceeding stacks of web located on the elevator platform.

The elevator platform can include a conveyor system for driving a completed stack of folded web to a discharge location. A pair of side-by-side elevator platforms can be provided according to this embodiment, wherein each platform is filled and moved to a discharge location while the adjacent platform is moved into a location to receive further stacks from the conveyor. Similarly, a carousel discharge mechanism can be provided wherein the elevator platform transfers a completed stack to the carousel and the carousel, subsequently, rotates to position the stack adjacent a selected discharge location.

According to another embodiment, the supporting surface can include a locking mechanism that maintains a supporting surface in communication, or "flush engagement", with the conveyor. By "communication" it is meant that the web can be conveyed from the supporting surface by the conveyor. In this orientation, the folder and separator can be directed to provide a continuous output of folded web onto the conveyor that is continuously driven downstream in a "waterfall" configuration to the downstream location.

The elevator platform, according to this embodiment, can further comprise a compression plate that moves downwardly onto a top of the stack of folded web thereon at selected times. The compression plate can be driven so that it follows the stack as it ascends and descends on the elevator platform. The compression plate can include a bearing that enables the plate to rotate as the stacks are rotated by the turntable drive.

The compression plate, conveyor, elevator platform, elevator discharge mechanism, pusher mechanism and supporting structure can each be controlled by a controller that, in one embodiment, can comprise a microprocessor. The controller can receive signals from the folder and separator or other upstream processing device. The conveyor can be instructed to move web downstream in response to the operation of a cutter in the folder and separator or, alternatively, in response to a preprogrammed page counter that indicates when a desired web section has passed through the folder and separator and is deposited on the supporting surface. The conveyor can be instructed in increments so that a discrete folded stack of web is positioned at an intermediate location for a selected time prior to its disposition on the elevator platform.

BRIEF DESCRIPTION OF THE DRAWINGS

The foregoing and other objects and advantages of the invention will become more clear with reference to the following detailed description in which.

DETAILED DESCRIPTION OF THE PREFERRED EMBODIMENT

Figure 1:
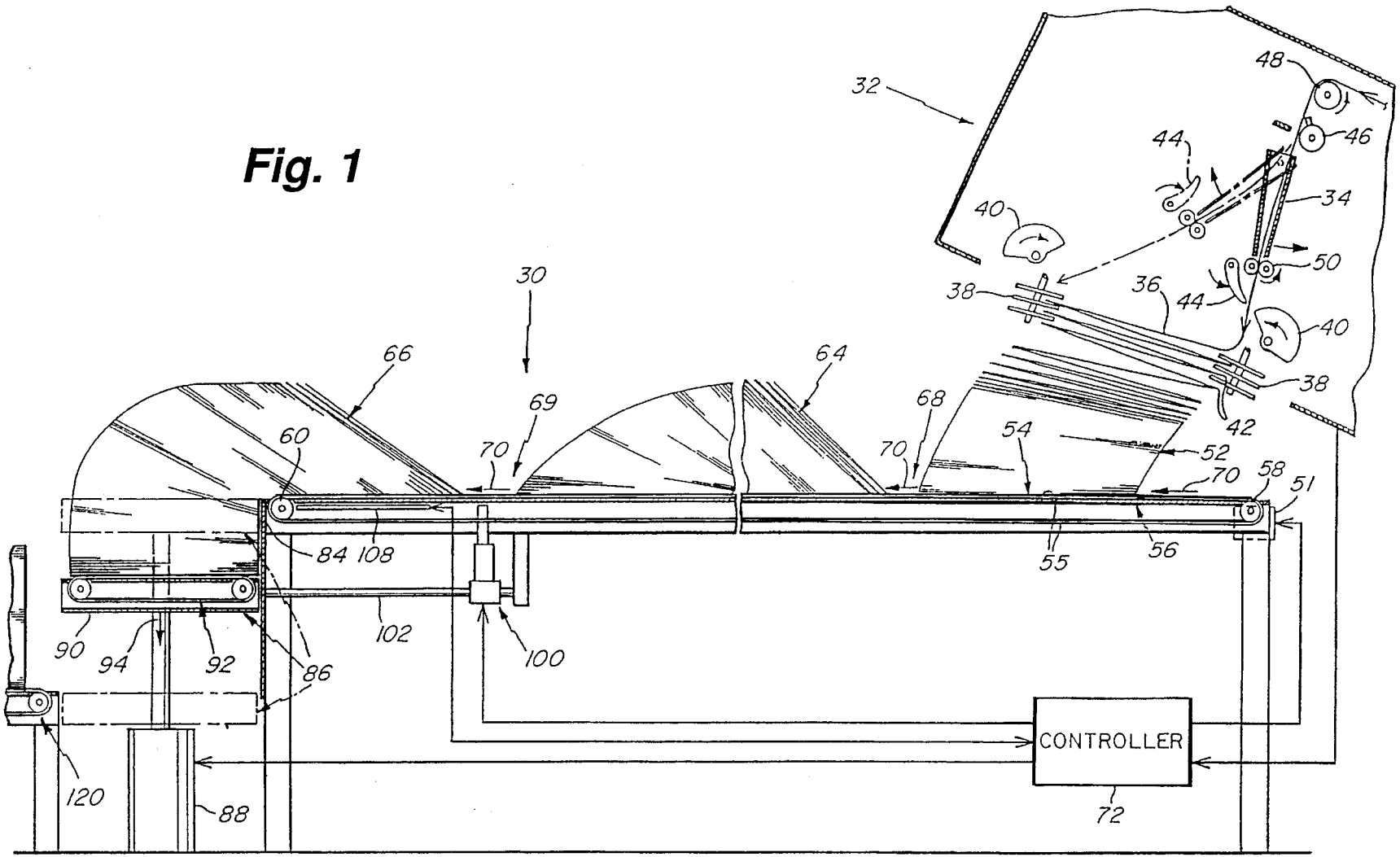
FIG. 1 is a schematic side view of a conveyor for forming discrete stacks of folded web according to one embodiment of this invention.

FIG. 1 illustrates a conveying system 30 for folded sheets according to one embodiment of this invention. A web folder and separator 32 is illustrated. The folder and separator 32 is of a type disclosed in Applicant's U.S. Pat. No. 5,149,075. It includes a swinging director chute 34 that delivers a continuous web 36 to two pairs of supporting spirals 38 and beaters 40 that rotate to form creases in the web. In one embodiment, the web 36 includes perforations or other weakened areas that enable the beaters 40 to form creases 42 along fold lines of the web. The director chute 34 according to this embodiment further includes a retracting finger structure 44 that alternatively retracts (shown in phantom) and extends to provide a further downstream guiding structure to the web to maintain it in appropriate alignment with the downstream folding mechanism (38 and 40). The depicted finger structure 44 rotates between an extended and retracted position. However, the fingers can be constructed to slide linearly between an extended and retracted position according to an alternate embodiment. It is desirable primarily that the fingers are selectively movable into and out of the path of web travel. In this embodiment, extension of the finger structure 44 occurs adjacent the rightmost beater structure (as illustrated in FIG. 1).

The separator 32 also includes a cutter 46 that, in this embodiment, comprises a rotary cutter, located in an upstream end of the chute 34. Web 36 is driven into the chute 34 by, in this embodiment, a clutch-operated drive roller 48 that can include pinfeed tractors and the web is directed from the chute by a pair of downstream pinch rollers 50 located at a downstream end of the chute.

In this embodiment, the supporting spirals 38 rotate to deliver the folded web 36 into a stack 52 located below the spirals 38. The stack is supported, according to this embodiment, by a conveyor 54 that comprises a plurality of parallel continuous belts 55 mounted on a table 56 between two opposing rollers 58 and 60. At least one of the rollers is driven by a motor 51 sized and arranged to move the belts 55 to transport the stack 52 downstream. In this embodiment, there is a separation between the stack 52 and more downstream disposed stacks 64 and 66. A gap 68 and 69 is positioned between each of the respective stacks 52, 64 and 66. This gap enables the identification of discrete stacks which facilitates the separation of folded sheets into different discrete packages that may be divided based upon job contents or other criteria.

As illustrated, the conveyor belts 55 are moving in a downstream direction (arrows 70) at a given speed of travel. Hence, each stack 52, 64 and 66 is formed in a "waterfall" pattern. In other words, the upstream and downstream edges of the stack are not square but, rather, curved relative to the direction of motion. This is because the conveyor belts 55 are moving while formation of the stack by the folder and separator 32 occurs.

Figure 2:
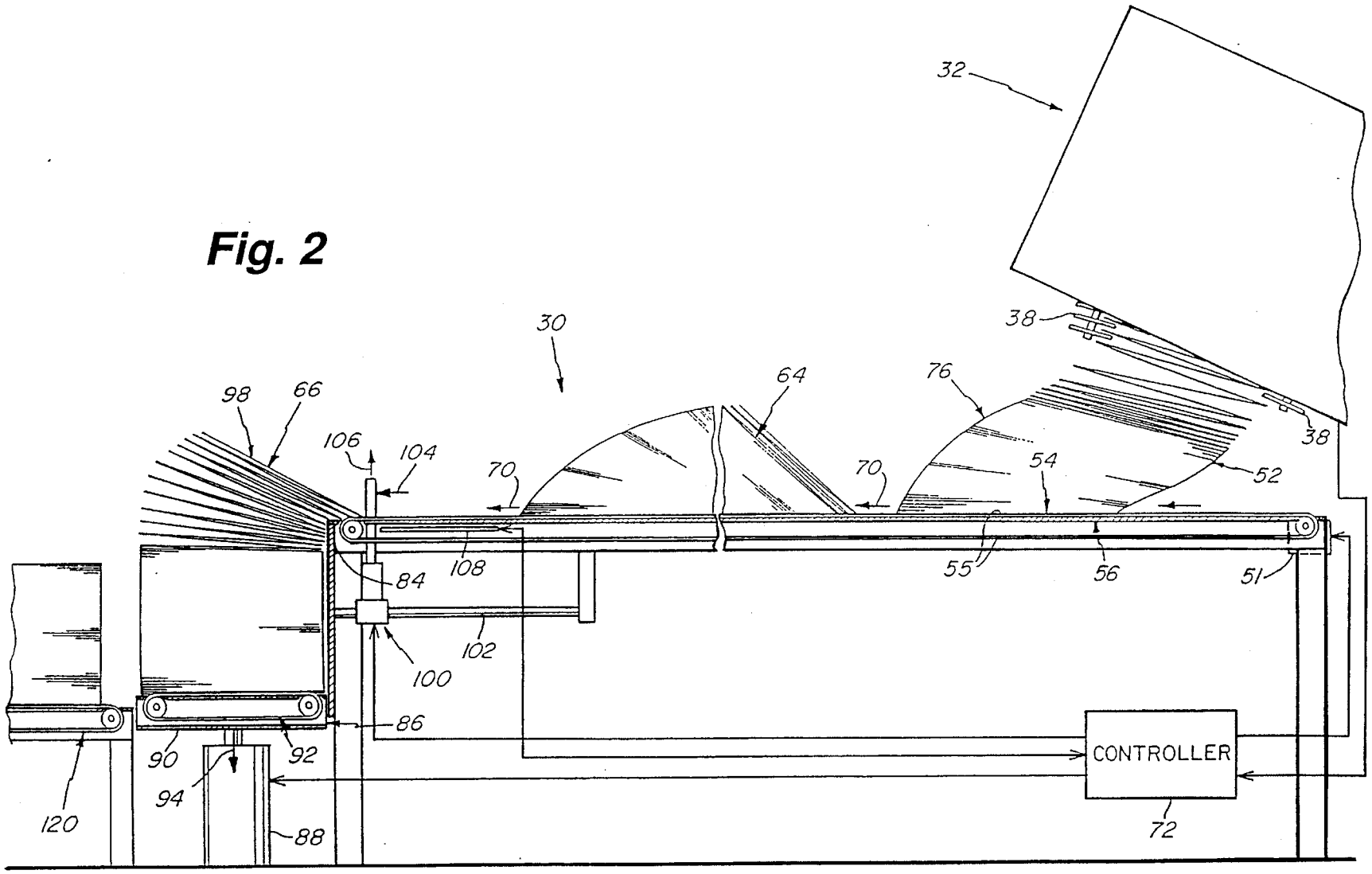
FIG. 2 is a schematic side view of the conveyor of FIG. 1 detailing a further step in the stack formation process.

The folder and separator 32 according to this invention is interconnected with a controller 72 that can comprise a microprocessor or other central processing unit according to this invention. The controller 72 is also connected to the drive motor 51 of the conveyor 54. The controller 72 receives signals from the cutter 46 or the cutter's controller (not shown). Upon receipt of a "cut" signal, the controller 72 directs the drive motor 51 to increase the downstream speed of the conveyor belts 55. This process is illustrated by FIG. 2, which is described further below, in which the stack 52 defines a substantially more-downstream curve in its upper portion 76. As further illustrated in FIG. 3, the stack 52 becomes spread out upon the conveyor 54 and the increased conveyor speed guarantees that the next stack of folded web 78 exiting the conveyor becomes deposited upon the conveyor 54 after a gap 82 has formed between the stack 78 and the upstream-most end 80 of the stack 52.

Figure 4:
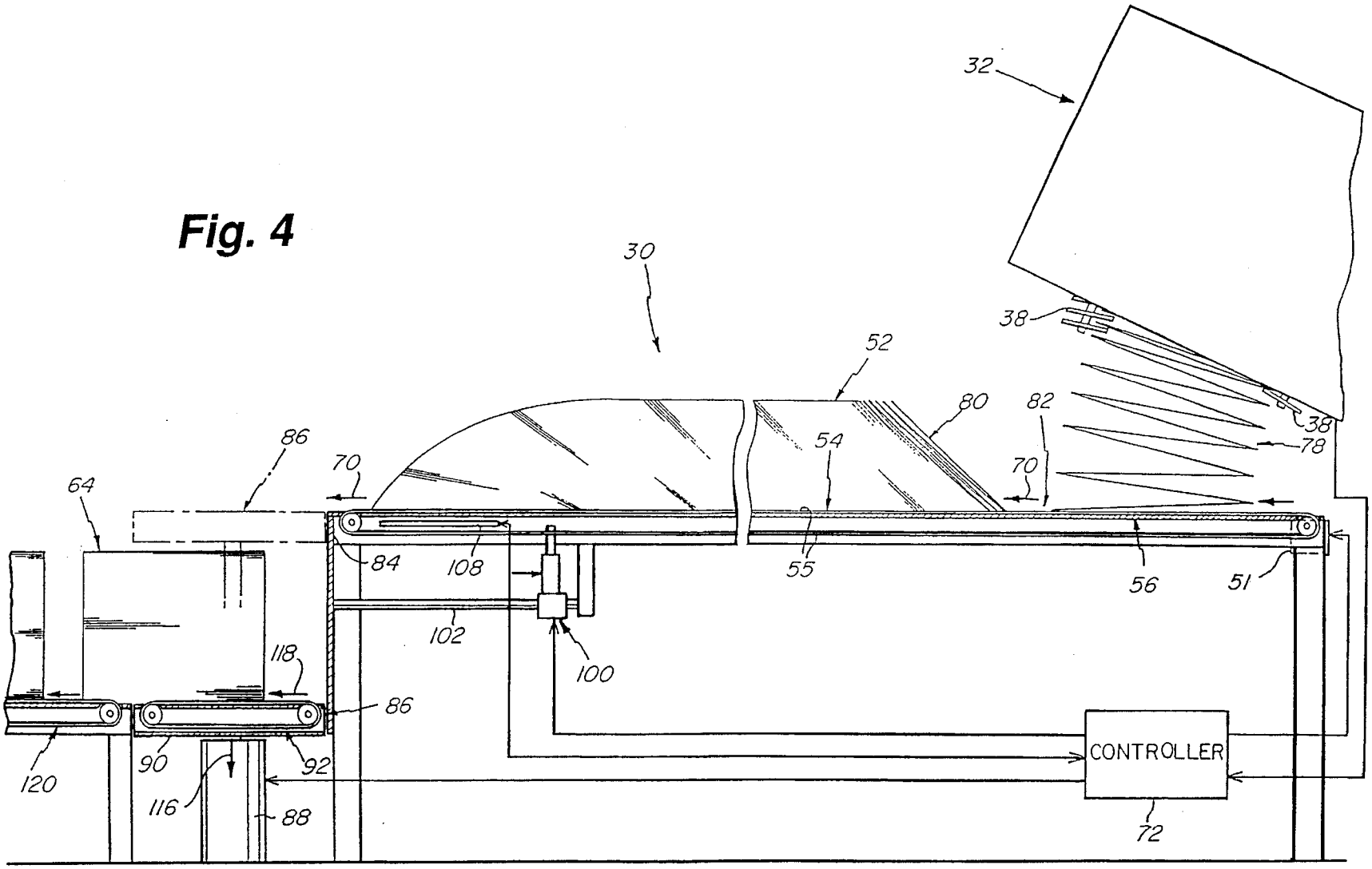
FIG. 4 is a schematic side view of the conveyor of FIG. 1 detailing another step in the stack formation process according to this invention.

Finally as illustrated in FIG. 4, a new stack 78 engages the conveyor 54 with a gap between it and the upstream end 80 of stack 52. Note that, according to this embodiment, the conveyor alternates between a slower and a faster speed during the stacking and gap-forming processes. It is contemplated that the initial stack-forming speed can be zero. Hence, the stack will remain largely squared during formation and the firing of the cutter 46 will only then signal movement of the conveyor. This approach is sufficient for relatively small height stacks that will not interfere with the separator 32. However, higher stacks generally entail the use of a waterfall formation process in order to ensure that the overall stack height does not rise beyond a maximum height.

As each separated stack 52, 64, 66 and 78 proceeds downstream in turn, it is driven off the edge 84 of the table 56 by the conveyor belts 55. It is received by the stacking elevator 86 according to this invention. The stacking elevator, in this embodiment, comprises a lifting mechanism 88 that is interconnected with the controller 72. The lifting mechanism is mechanically interconnected with the elevator platform 90. The elevator platform according to this embodiment includes a conveyor belt unit 92. Each stack is driven by the conveyor 54 onto the elevator platform 90. The elevator rises to a height that is in line with or near the conveyor table 56 (shown in phantom). In this position it receives each new stack. The elevator then declines (arrow 94) as additional folded sections are delivered by the conveyor 54 to the platform 90. Declination of the elevator platform 90 can be accomplished by means of a weight sensor or by a logic circuit in the controller 72 that determines the number of sheets delivered by the folder and separator 32 to the table. As a completed stack (66 in FIG. 2) is formed on the platform 90, a few remaining trailing sheets 98 may remain partially disposed on the conveyor table 56. Accordingly, a retracting finger 100 is provided. The finger moves along a rail 102 in a downstream direction (arrow 104). It remains out of contact with the stacks moving along The table until a completed stack is formed on the platform 90. At this time, the controller 72 signals the finger extend upwardly into interfering contact with the sheets on the table (arrow 106) and to move in a downstream direction (arrow 104) to force the trailing sheets 98 onto the top of the stack 66 resting on the platform.

Figure 3:
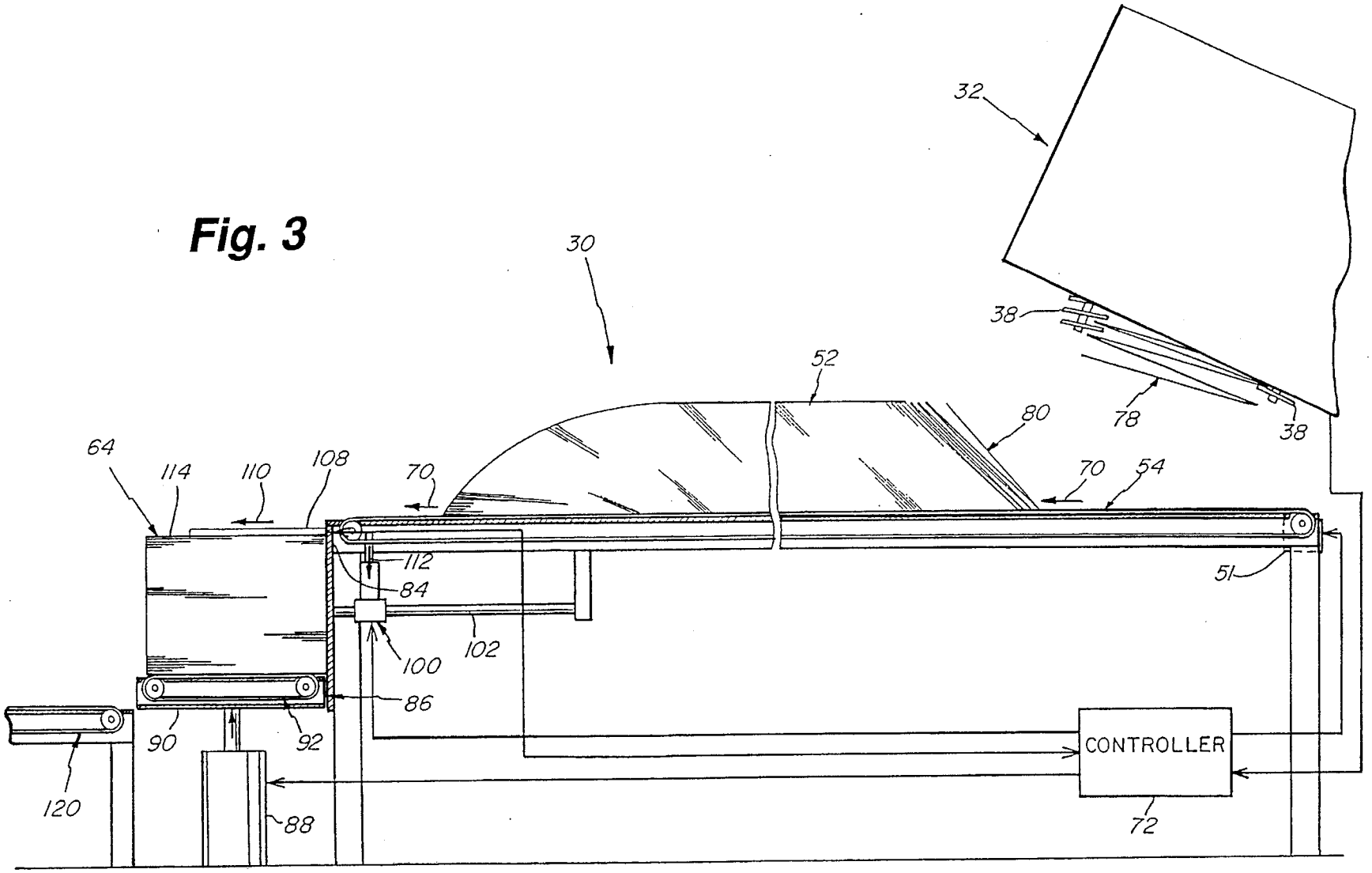
FIG. 3 is a schematic side view of the conveyor of FIG. 1 detailing yet another step in the stack formation process according to this invention.

Subsequent to formation of a completed stack on the platform 90, as illustrated for stack 64 in FIG. 3, the stack, which (due to its waterfall configuration) includes substantial air between each of its folded sheets, is compressed. A compression plate 108 extends (arrow 110 in FIG. 3) into a position overlying the stack 64. The compression plate blocks upward movement of the stack. Hence, subsequent to retraction of the finger 100 (arrow 112), the controller 72 signals the elevator mechanism 88 to raise the platform 90, bringing the top face 114 of the stack 64 into contact with the plate 108. Accordingly, the action of the elevator mechanism 88 causes the stack to become compressed against the platform 90 and the plate 108. The plate 108 can include a gimble mechanism or pressure sensor that determines when an optimum compression of the stack has occurred. At this time, most of the air bubbles or space have been removed from the sheets of the stack 64.

As further detailed in FIG. 4, the elevator platform again declines (arrow 116) upon direction of the controller and subsequently directs the platform conveyor 92 to transfer the stack 64 (arrow 118) onto the transport conveyor 120 for delivery to a remote location. As a stack 64 is removed from the plate 108 retracts and platform is again moved into an upward position (as shown in phantom in FIG. 4) for receipt of the next stack 52. As the next stack 52 is driven onto the elevator platform 90, the platform again descends to allow formation of an enlarged vertical stack.

Figure 5:
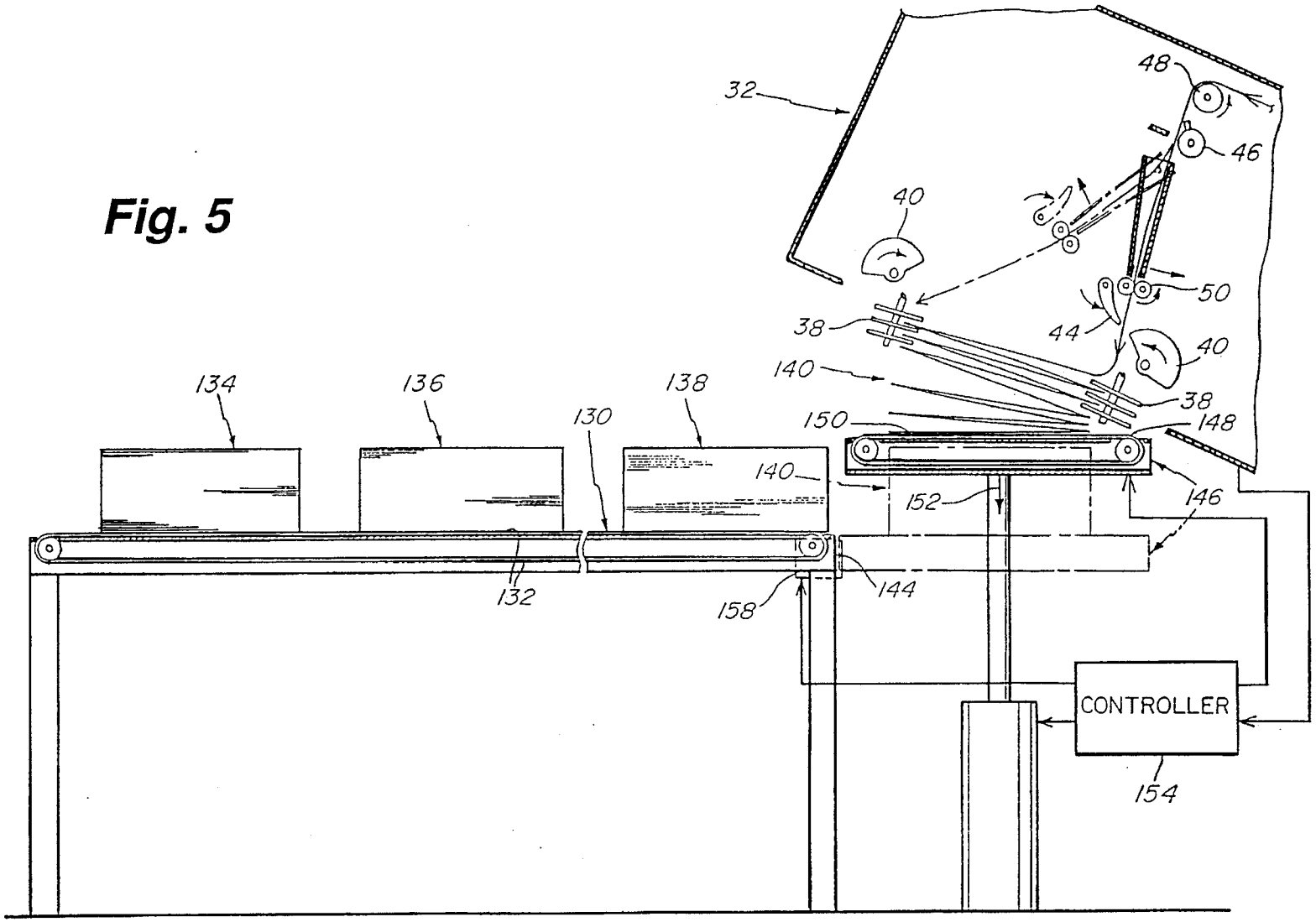
FIG. 5 is a schematic side view of a conveyor for forming discrete stacks according to an alternate embodiment of this invention.
Figure 6:
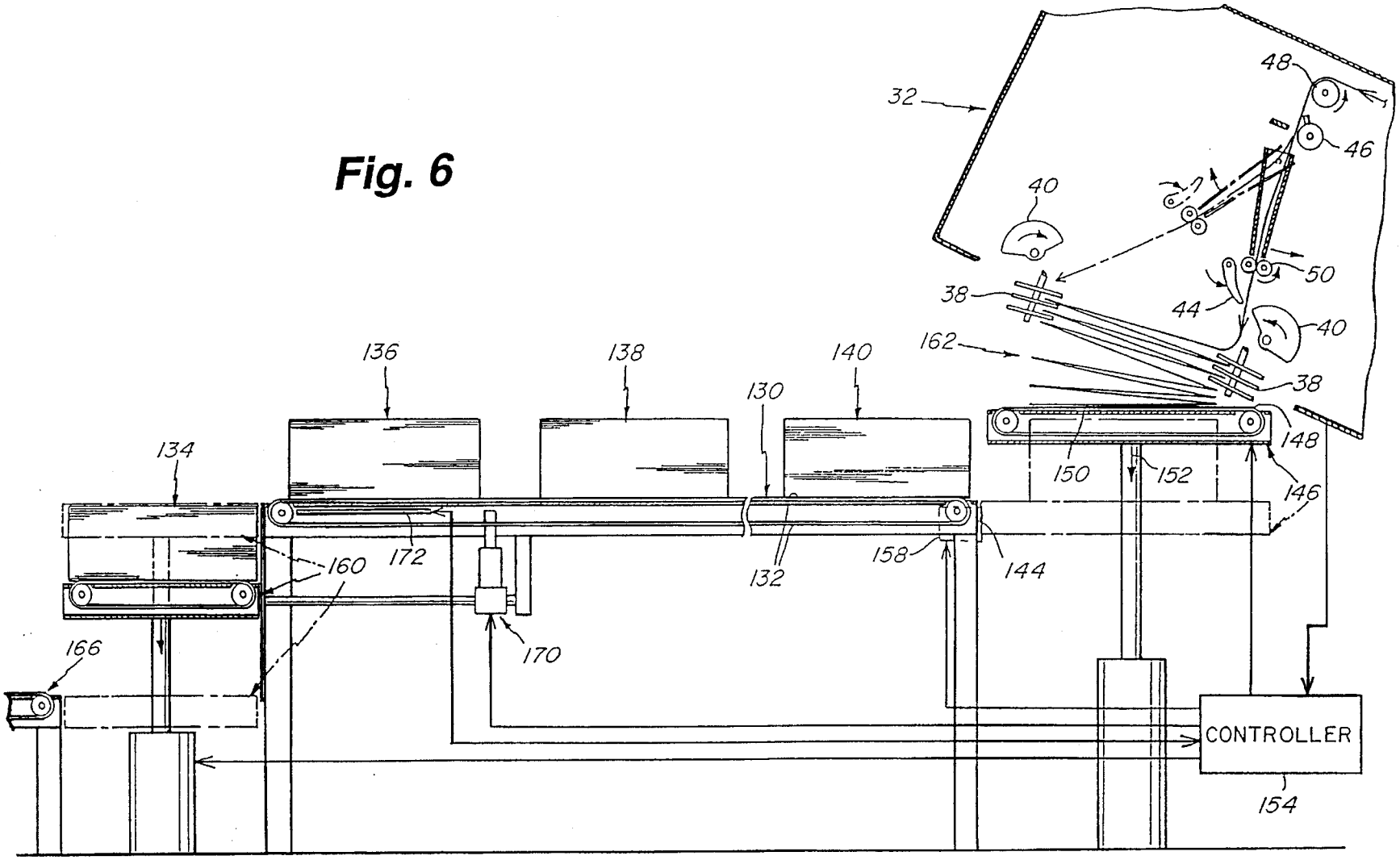
FIG. 6 is a schematic side view of the conveyor of FIG. 5 including a downstream stack-forming elevator according to this invention.

As noted above, the embodiment of FIGS. 1–4 can be used to form large discrete stacks from a continuous waterfall flow of folded zig-zag web. FIGS. 5–6 illustrate an alternate embodiment according To this invention, in which larger size stacks can be formed at the folder and separator 32 without altering the configuration of more downstream-disposed stacks. In this embodiment, the conveyor 130 includes belts 132 that support three discrete stacks 134, 136 and 138. The folder and separator 32 is forming a new stack 140. The conveyor 130 includes an upstream end 144 that terminates before the folder and separator 32. Accordingly, the new stack 140 is formed on a moving platform 146 having a separate conveyor belt assembly 148. According to this embodiment, the platform enables the bottom end 150 of the stack 140 to be brought into close proximity to the spirals and beaters 38 and 40 of the folder and separator 32. Hence, a more tightly-compressed stack can be formed proximate the folder and separator 32.

As the stack is formed, the conveyor platform 146 can descend (arrow 152) to account for the growth in this stack. The descending of the conveyor can be based upon the weight of the stack or based upon the number of sheets output from the folder and separator 32 or upon back pressure sensing by input side spiral through mechanical loading. Such information is directed to the controller 154, according to this embodiment. When the stack has attained a desired size, the conveyor platform 146 descends into alignment with the more downstream conveyor 130 (as shown in phantom). At this time, the controller 154 can direct the conveyor 148 to transfer the completed stack downstream. Simultaneously, the controller 154 can direct the drive 158 of the conveyor 130 to move the stacks 134, 136 and 138 further downstream.

As shown in FIG. 6, the conveyor according to this embodiment can include a stacking elevator platform 160 that responds to the controller 154. Hence, the downstream-most stack 134 is delivered to the elevator platform 160 while each of the more-upstream stacks 136 and 138 and the newly-formed stack 140 are still disposed upon the conveyor 130. Note that another stack 162 is being formed by the separator and folder 32. When complete, this stack will be delivered to the conveyor 130 while the more downstream stack 136 is delivered to the elevator platform 160. The downstream-most stack 134 is simultaneously delivered to the transport conveyor 166 for delivery to a remote location.

The conveyor system according to this embodiment, like that of FIGS. 1–4, can be used in conjunction with a waterfall flow. By setting the controller so that the conveyor 146 is locked in alignment (as shown in phantom) with the downstream conveyor 130, and by causing the upstream conveyor belt 150 and downstream conveyor belt 132 to move at a desired rate, a waterfall of continuous flow sheets can be produced. If the platform 146 is simply lowered into alignment with the downstream conveyor 130, then a substantial amount of folded sheet slack can be present between the folder and separator 32 and the surface of the conveyor belts 150. Accordingly, substantial air bubbles can form in such a waterfall flow. Conversely, the platform 146, according to this embodiment, is held in close proximity to the folder and separator 32, as shown in FIG. 6, and can be lowered in relatively small increments as a highly compressed stack of folded web is output from the folder and separator 32. Only when the highly compressed stack has reached a sufficient height, typically, approximately equal to the distance between the spirals 40 and the level of the downstream conveyor 130, is the conveyor belt set 150 and downstream conveyor belt set 132 activated. Conveyor belts 150 and 132 are driven, typically, at a rate that matches the rate at which folded sheets are outputted from the folder and separator 32. Hence, a highly compressed waterfall flow is maintained adjacent the folder and separator as the more downstream sheets are transported away from the folder and separator 32.

Since the embodiment of FIG. 6 contemplates the formation of waterfall flow, the downstream end of the conveyor 130 is equipped with a pusher finger 170 according to this embodiment. As in the embodiment of FIGS. 1–4, the pusher finger retracts upwardly (not shown) into the path of the conveyor belts 132 to force any remaining upstream sheets of a waterfall flow onto the top of a stack formed on the elevator platform 160. A compression plate 172 is also utilized to further compress the waterfall flow of the stack. According to this embodiment, much of the free space between sheets in a stack of web is eliminated, enabling more compact conveyor elements and a more rapid outputting and stacking process than would be possible for a more loosely arranged stack of zig-zag folded sheets.

A conveyor system according to a preferred embodiment is illustrated in FIGS. 7–15. The conveying system according to this embodiment includes an additional feature, according to this invention, that enables the formation of stacks of zig-zag folded sheets comprising a plurality of detached sections in which each of the sections in the stack are offset to provide an indication of section boundaries.

Figure 7:
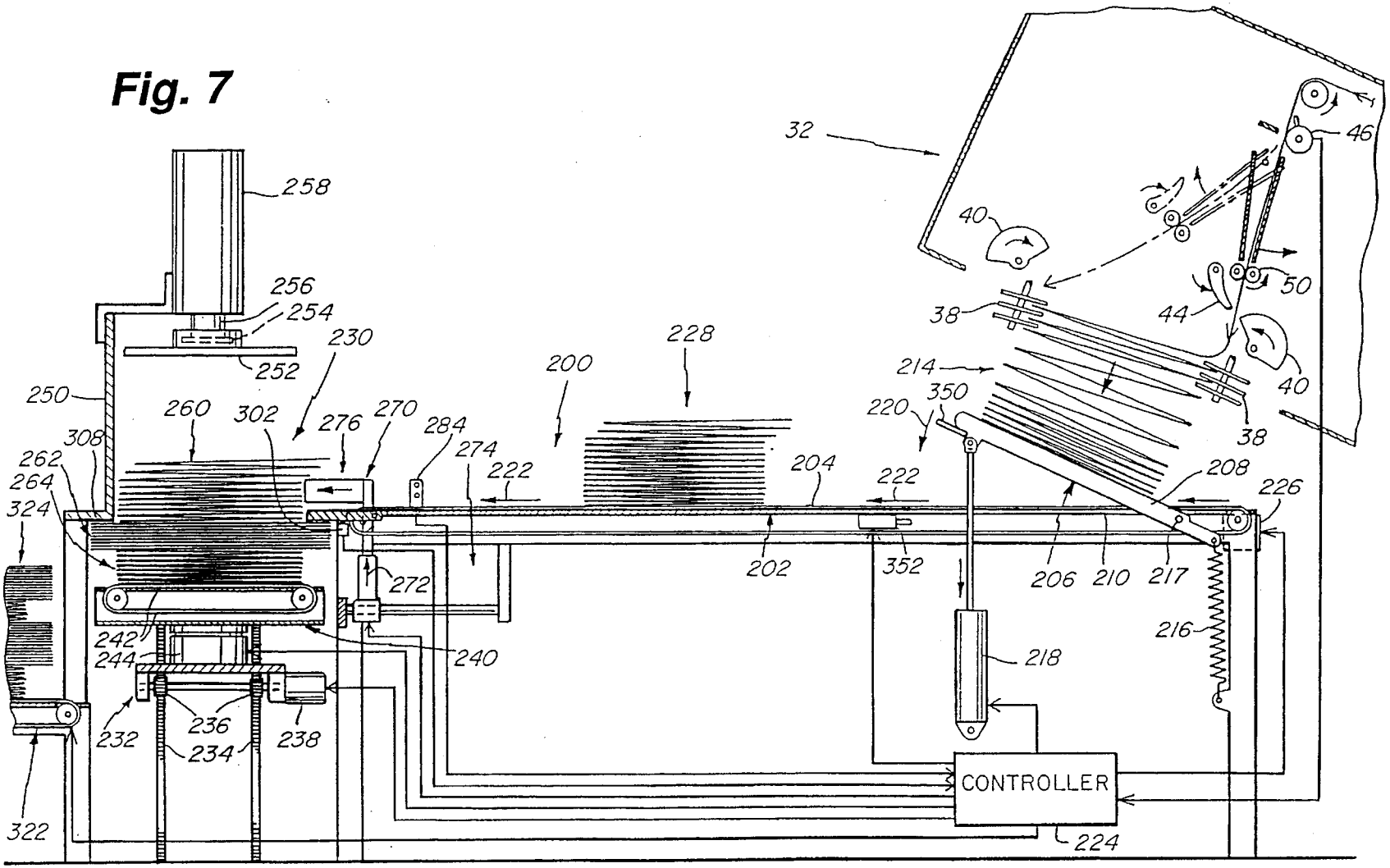
FIG. 7 is a somewhat schematic side view of a conveyor system including an offset stacker according to another embodiment of this invention.
Figure 8:
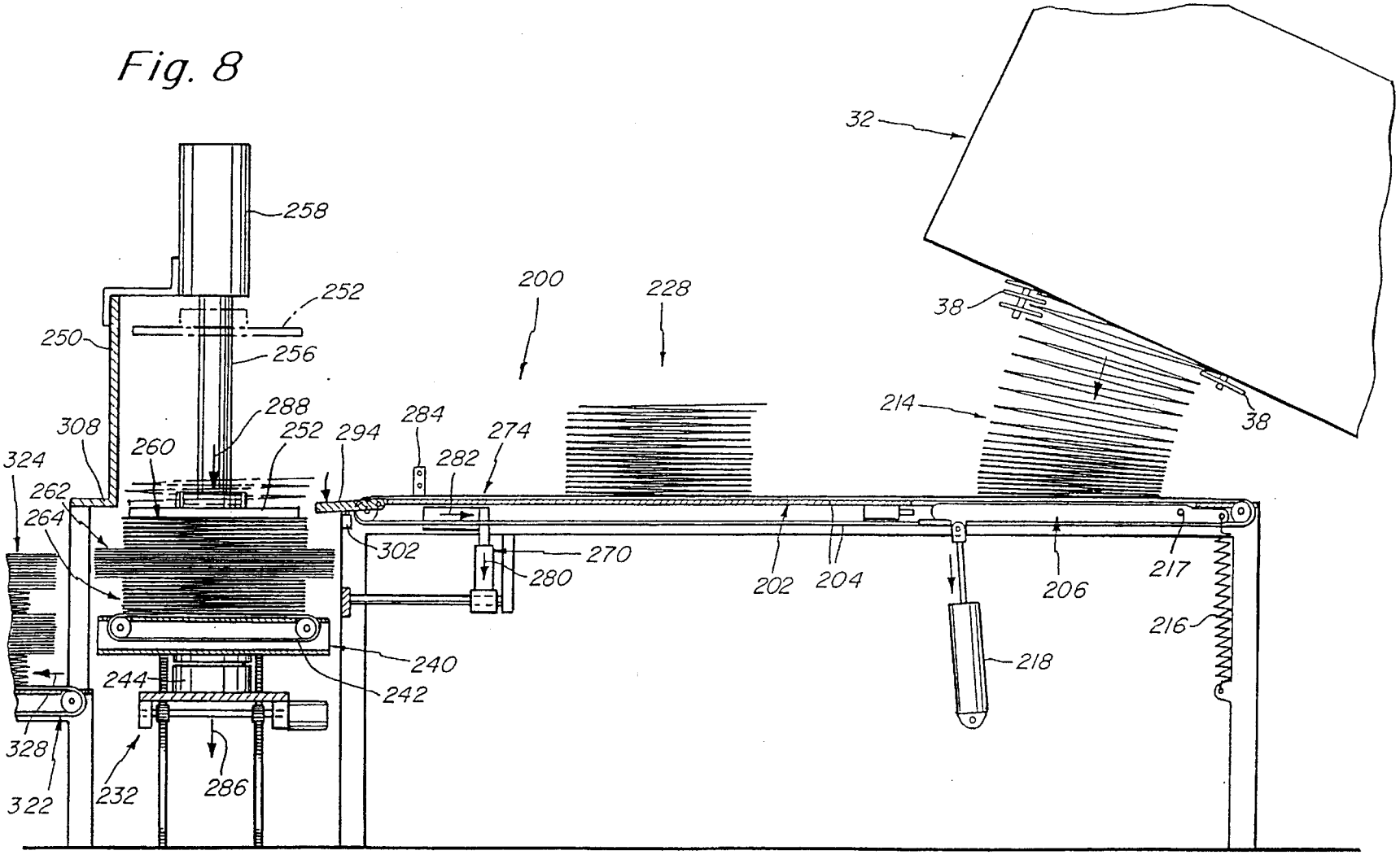
FIG. 8 is a somewhat schematic side view of the offset stack-forming process utilizing the conveyor according to FIG. 7.

FIG. 7 illustrates an overview of the conveying system 200 according to this embodiment. A stacker and separator 32 such as that shown in the previous embodiments overlies a conveyor table 202 having moving conveyor belts 204. Adjacent the upstream end of the conveyor table 202 is located a pivoting support assembly 206 according to this embodiment. The support assembly 206 is depicted generally in plan view in FIG. 15. It comprises a plurality of narrow rails or beams 208 located in slots 210 formed in the conveyor table 202. The rails 208 are offset from each of the belts 204 so that they do not interfere with them, but, rather, can be raised and lowered out of the plane of the table 202 to support a stack of sheets output by the folder and separator 32.

With reference to FIG. 7, a stack 214 is deposited on the support assembly 206 by the folder and separator 32. The support assembly 206 maintains a stack 214 out of contact with the conveyor belt 204. Accordingly, the stack 214 is compressed in a stationary position by the addition of further folded web by the stacker and separator.

The rails 208 of the support assembly 206 are held upwardly away from the conveyor belts 204 by a spring 216 located on the opposite side of the pivot 217 from the upwardly extended portions of the beams 208. The spring 216, in this embodiment, comprises a tension coil spring. However, any acceptable force-producing component can be utilized to force the beams upwardly toward the folder and separator 32. For example, the spring can be replaced with a servo or linear actuator. Such an actuator 218 is illustrated in FIG. 7 for use in conjunction with the spring 216. This actuator 218 will be described further below.

The spring 216 provides a desired moment on the support assembly 206. The spring force is chosen so that the supporting assembly remains in an extended state during the initial formation of the stack 214. According to this embodiment, the spring force is overcome completely to move the support assembly into flush engagement with the conveyor table 202 when the compressed stack extends into substantial proximity with the spirals 38. However, the spring constant can be changed so that the support assembly 206 drops into the engagement of smaller and lighter weight stacks. It should be noted that the support assembly of this embodiment, drops continuously as the weight and size of the stack thereon output from the folder and separator 32, increases. As such, the weight of the stack causes the support assembly 206 to descend as shown by the arrow 220. In this manner, a highly compressed stack that is largely free of air space or bubbles is generated while the stack 214 is suspended above the conveyor table 202 and belts 204. Only when the stack has attained a certain compressed size will its weight be sufficient to bring the stack into contact with the conveyor.

As noted above, an actuator 218 can be provided according to this invention. The actuator 218 can be used to override the spring 216 and place the stack 214 into contact with the conveyor belts 204 when a certain weight is attained by the stack 214. This feature is desirable when small sized stacks are produced that would not overcome the spring force. A sheet count can be used to determine when the actuator 218 should be operated.

As illustrated in FIGS. 7–12, stacks are driven down the conveyor table 202 as illustrated by the arrows 222 in a discrete arrangement. Each completed stack is brought into contact with the conveyor either by the action of the actuator 218 or by the stack's weight overcoming the spring 216. As a stack is completed, the controller 224 receives a signal from, for example, the cutter 46 to power the conveyor belt drive 226. Stacks are transferred downstream, according to this embodiment, from the supporting assembly 206 to a stationary intermediate position 228 and, finally, to a stacking position 230. The transfer will be described further below. According to this embodiment, The positioning of a stack at the intermediate position 228 enables the operator to view the contents of the stack to insure that correct output has occurred. The stacking location 230 according to this embodiment differs from the previous embodiments in that it enables offset separation of stacks of web. The stacking location 230 includes an elevator 232 that, in this embodiment, comprises a pair of racks 234 and pinions 236 having a drive motor 238 interconnected with the controller 224. Alternatively, a pneumatic cylinder or any other suitable linear drive can be utilized according to this invention.

The supporting elevator base or platform 240 of the elevator 232 includes a separate conveyor belt 242 similar to that shown and described in previous embodiments. The elevator platform 240, however, according to this embodiment is supported by a turntable drive 244 that is also interconnected with the controller 224. The turntable drive, according to this embodiment, can comprise a geared motor or rotary solenoid, or any other appropriate mechanism that enables the elevator platform 240 to be rotated relative to the downstream direction (see, for example, arrow 246 of FIG. 9). In this embodiment, the turntable drive 244 can include a pair of limit switches located at 90° angles to each other that maintain the turntable within a 90° rotation. However, it is contemplated that rotation can occur throughout 360°. Above the base, on a support beam 250, is positioned a compression plate 252 mounted on a rotary bearing 254 to a shaft 256. The shaft 256 is driven upwardly and downwardly by a cylinder 258. The function of the compression plate 252 is described further below.

In summary, the elevator 232 receives stacks of web from the conveyor table 202, and rotates so that succeeding stacks received thereby are oriented at right angles relative to preceding stacks. Since stacks are generally delivered in a "landscape" orientation (with a shorter length oriented along the downstream direction), the preceding stack is generally rotated into a "portrait" (the long dimension located in the downstream direction) orientation. As illustrated in FIG. 7, the uppermost stack 260 has just entered the elevator 232. The preceding stack 262 is offset at 90° in portrait mode. Similarly, the lowermost stack 264 is parallel to the newly added stack 260 and is in landscape mode. The operation of the conveying and separating system 200 according to this embodiment is further described as follows:

According to FIG. 7, a new stack 260 is being deposited upon two lower stacks 262 and 264 at the elevator 232. The controller has directed the conveyor drive 226 to deliver the stack 260 from the intermediate position 228 to the elevator 232. As the stack 260 arrives at the elevator 232, a retracting pusher assembly 270 extends into the path of the stack through the conveyor table 202 as shown by arrow 272. The pusher 270 moves from a rearward position 274 to a forwardmost position 276 to drive the tail end of the stack 260 onto the elevator platform 240.

The top stack 260 on the elevator platform is then compressed by movement of the shaft 256 to bring the compression plate 252 onto the top of the stack 260. Simultaneously, the supports 206 are driven downwardly, either by the weight of the stack or by action of the controller 224 (not shown in FIG. 8) to place the newly formed stack 214 onto the conveyor table 202. As further detailed in FIG. 8, the pusher assembly 270 has returned to a fully retracted state as shown by the arrows 280 and 282.

A sensor, which in this embodiment can comprise an optical sensor 284, is provided at the end of the conveyor table 202 according to this invention. The sensor 284 senses the passage of a stack through its path, indicating, that a stack is being positioned on the elevator platform 240. Accordingly, the sensor 284 signals a controller to begin the descent of the elevator platform as shown by arrow 286. As the elevator platform 240 descends, the compression plate 252 and shaft 256 descend with it as shown by the arrow 288. A pressure sensor or strain gauge can be incorporated into the compression plate 252 to maintain pressure exerted by it on the stack within predetermined limits so that the stack remains compressed. Such a pressure sensor regulates the stroke of the cylinder 258 in this embodiment. The sensor 284 can also signal the conveyor drive 226 to have operation since the passage of stack through the sensor 284 indicates that it is now deposited on the elevator platform 240.

Figure 9:
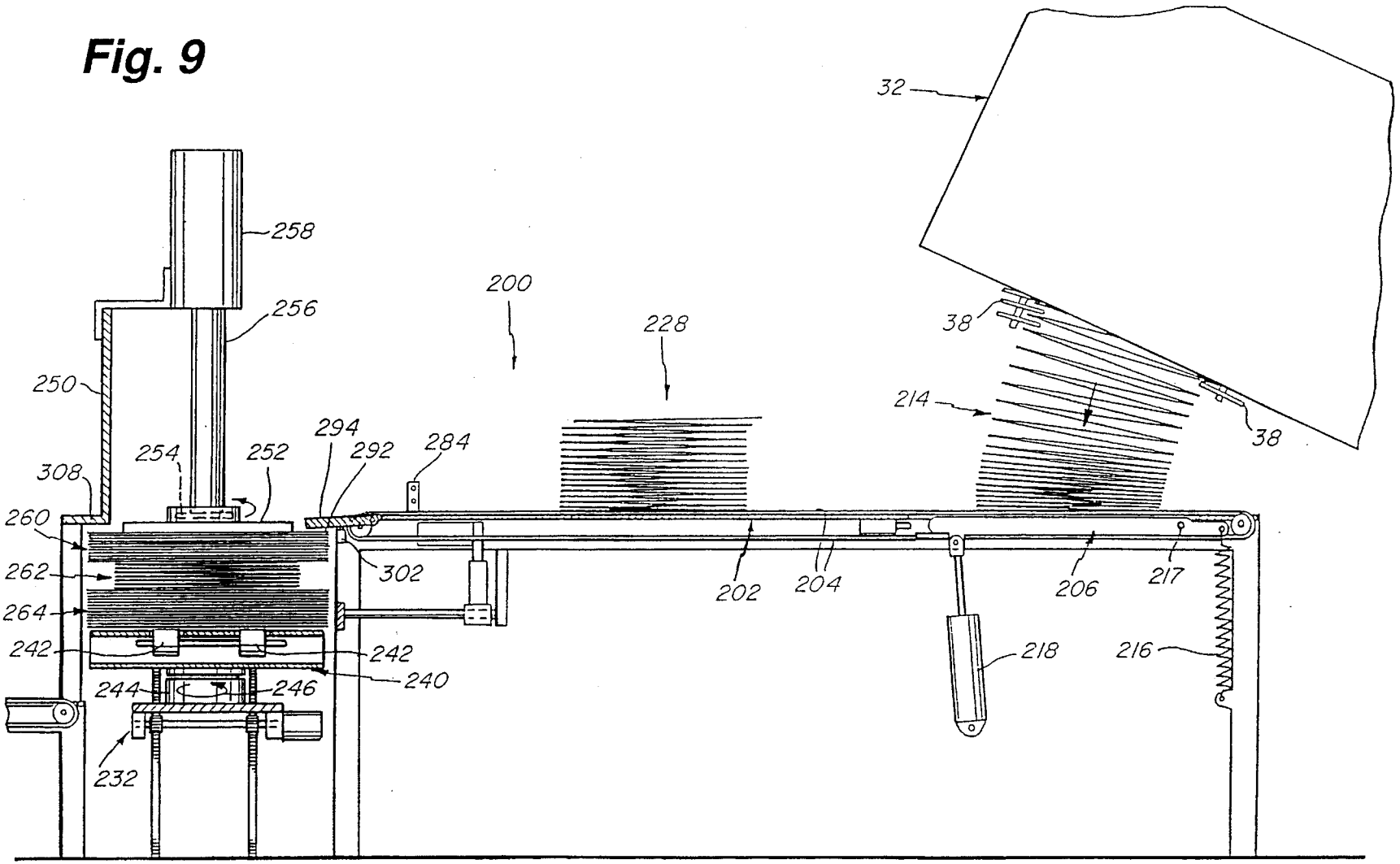
FIG. 9 is a somewhat schematic side view of another step in the process according to FIG. 8.

As further detailed in FIG. 9, as the elevator platform 240 descends, the turntable drive 244 causes the elevator platform 240 to rotate approximately 90° as shown by the arrow 246. Hence, the stack 260 is brought into a "portrait" orientation relative to the downstream direction. Similarly, the stack 262 positioned directly below the stack 260 it is now brought into landscape, so as to form alternating portrait and landscape separated stacks since the compression plate 252 follows the stack downwardly as the elevator platform 240 descends. Thus, rotation of the platform 240 via the turntable drive 244 causes the compression plate 252 to rotate on its bearing 254 relative the shaft 256. Note that the upstream end 292 of the stack 260 is now located below, and in an interfering relationship with, an overhanging pivoting plate 294 (FIG. 9). Hence, upon ascent of the elevator platform 240, the end 292 of the stack 260 engages the plate 294. This engagement is further detailed in FIG. 10 in which the elevator ascends, as detailed by the arrow 298. The interference between the edge 292 of stack 260 with the pivoting plate 294 causes the pivoting plate 294 to rise upwardly as detailed by the arrow 300. The pivoting plate 294 engages a microswitch 302 or similar sensor, that is interconnected with the controller 224 (not shown in FIG. 10). The microswitch 302 signals the controller to cease upward ascent of the elevator platform 240 since the stack 260 is now brought relatively flush with the conveyor table surface 202. An opposing edge 306 of the stack 260, likewise engages a shoulder 308 on the conveyor frame. Hence, according to this embodiment, both edges of the portrait-oriented stack 260 are retained against upward movement. Thus, a well-compressed stack is maintained with relatively little air space. Plate 252 is raised from the stack as indicated by the arrow 309. This operation is also performed by the controller 224 and can occur upon tripping of the microswitch 302 by the pivoting plate.

Figure 10:
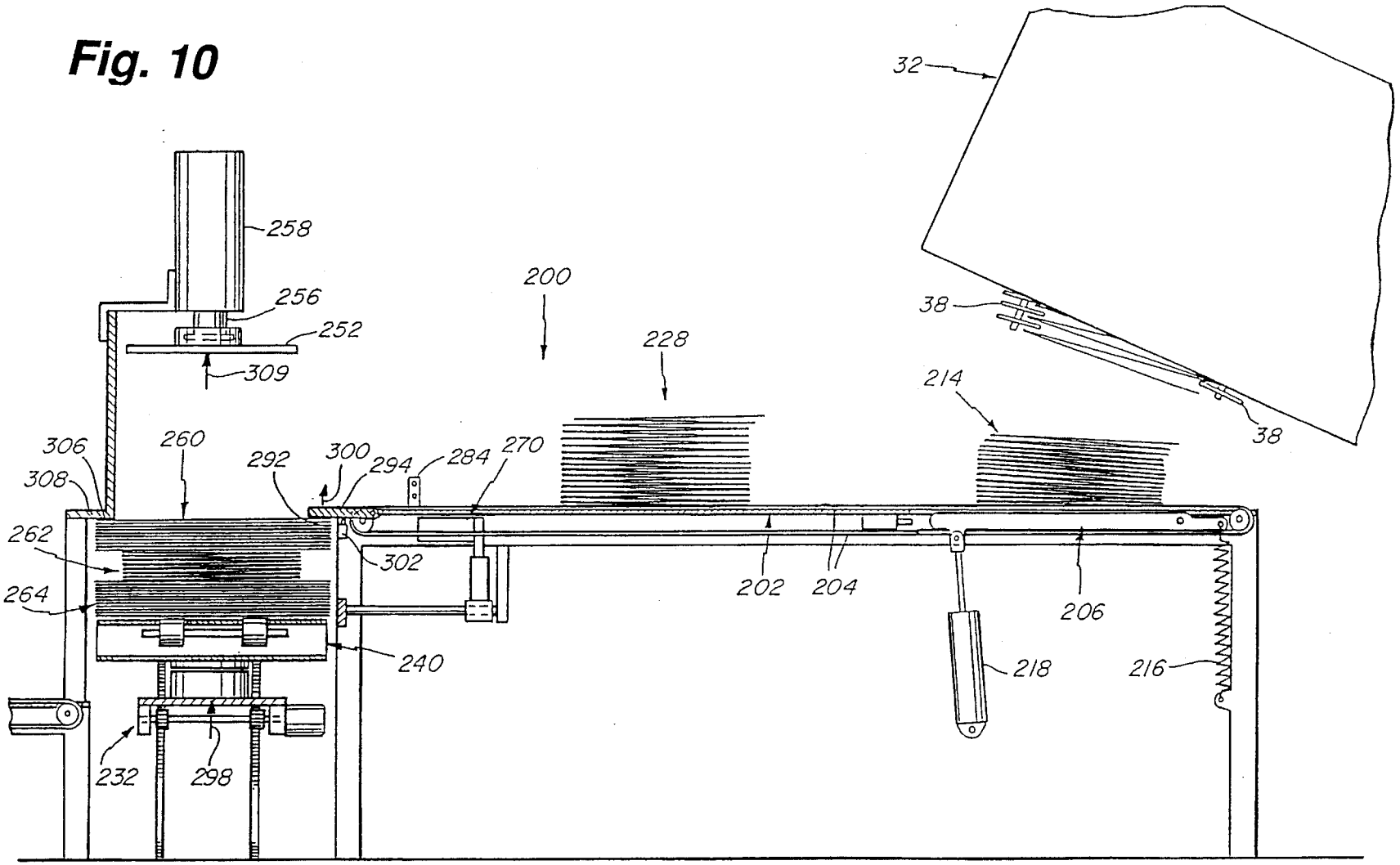
FIG. 10 is a somewhat schematic side view of another step in the process according to FIG. 8.
Figure 11:
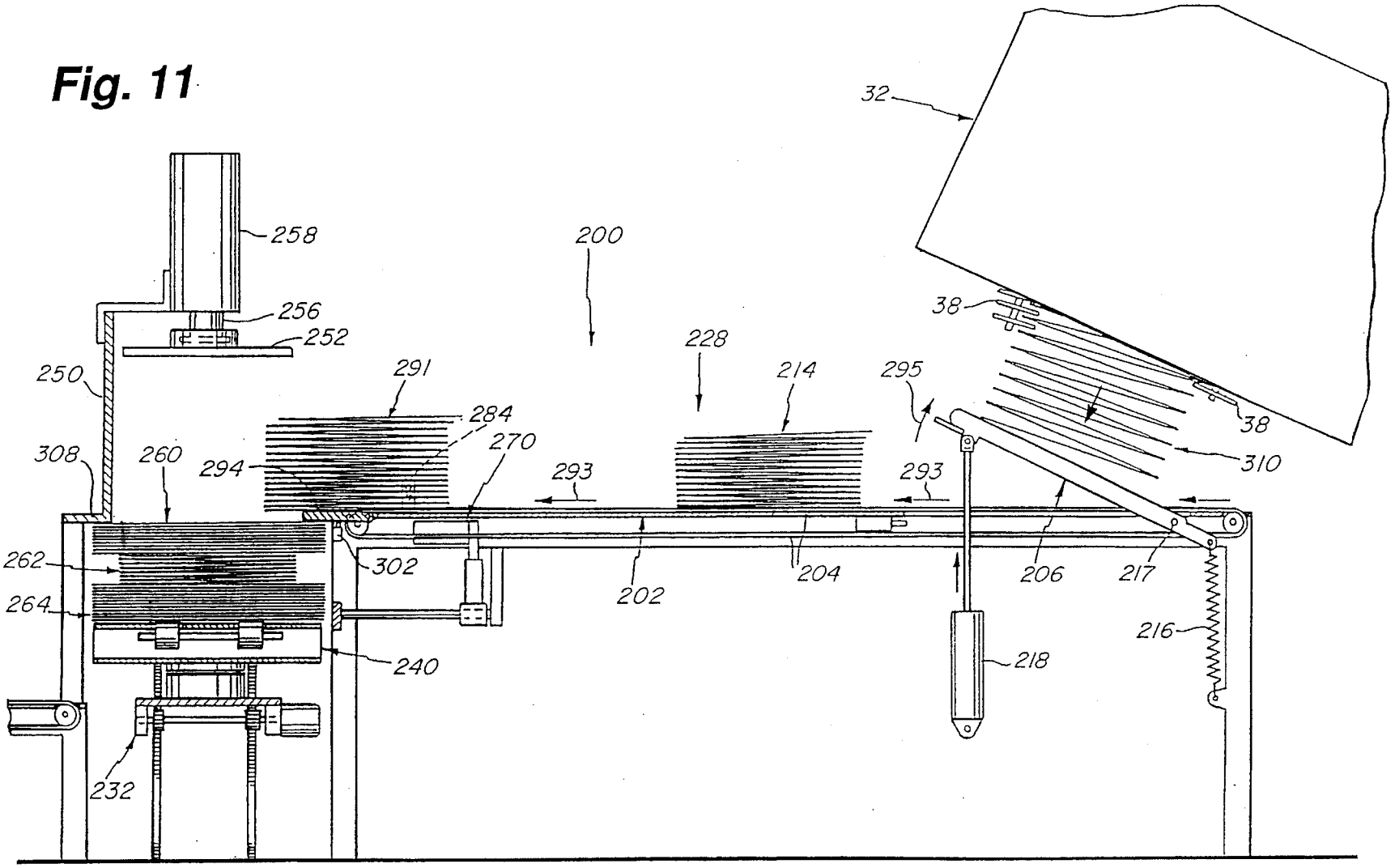
FIG. 11 is a schematic side view of another step in the process according to FIG. 8.

As indicated in FIG. 10, at this time, the upstreammost stack 214 has become separated from the stacker and separator 32. Hence, it is now located at the upstream end of the conveyor table 202 as a discrete stack. As shown in FIG. 11, the conveyor belts 204 are now operated to move the stacks 291 and 214 downstream (arrows 293). The, formerly, intermediate stack 291 is moved past The sensor 284, over the pivoting plate 294 and onto the previously-formed, portrait-oriented, stack 260 resting on the elevator platform 240. Stack 291 is oriented in a landscape orientation relative to the downstream direction. Having now been relieved of the weight of the upstream stack 214, the support assembly 206 is free to move upwardly (arrow 295) under the tension of their spring 216 to receive the next stack from the folder and separator.

Figure 12:
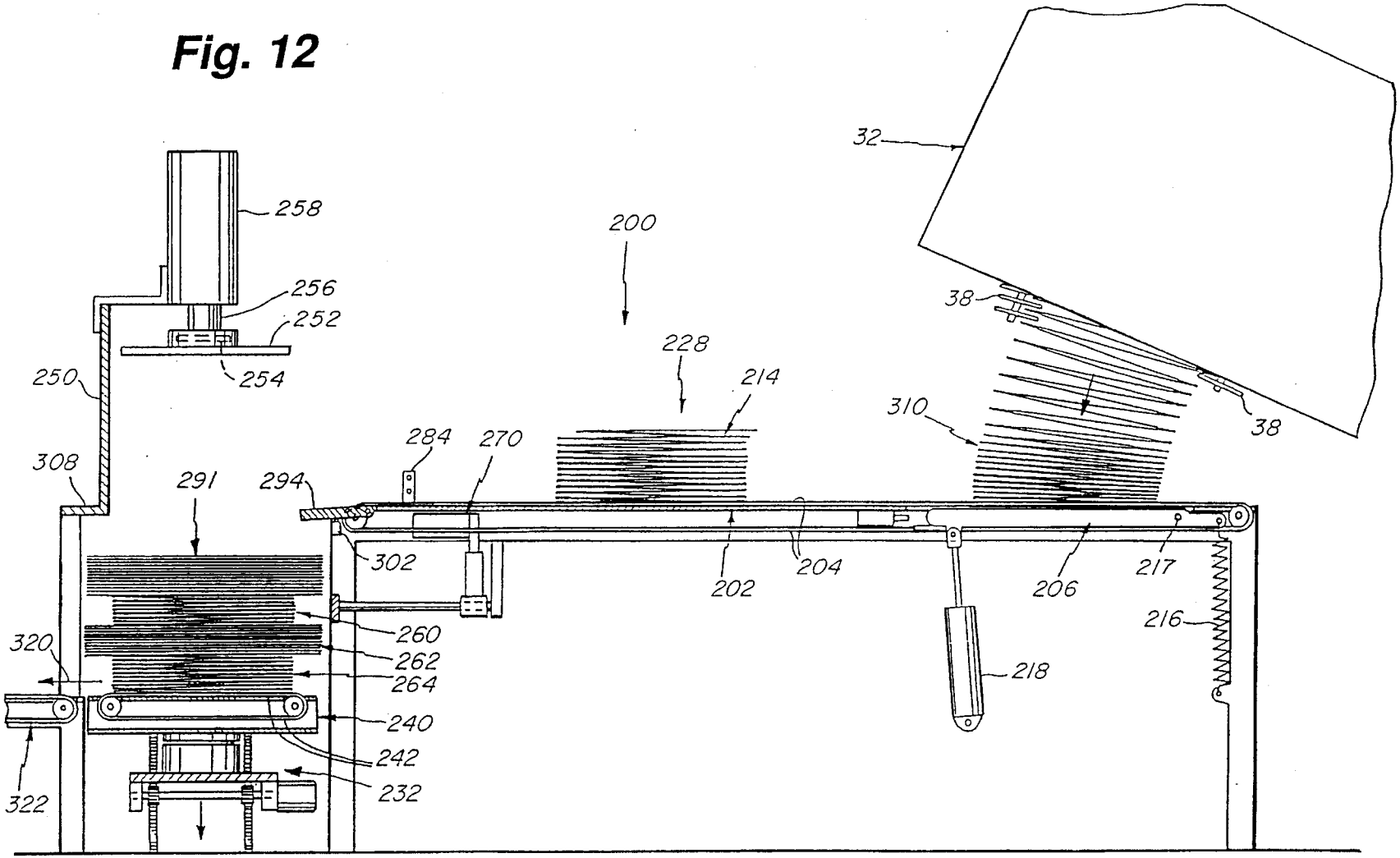
FIG. 12 is a schematic side view of another step in the process according to FIG. 8.

As further detailed in FIG. 12, the stack 291 is now fully-deposited onto the top of the preceding stack 260 on the elevator platform 240, the elevator platform 240 having rotated 90° and the conveyor assembly 200 having followed the steps as described above. The formerly, upstream stack 214 is now located stationarily in the intermediate position 228 for inspection, while the newly formed upstream stack 310 has compressed sufficiently to the support assembly 206 downwardly into flush engagement with the conveyor table 202.

Note that, according to this embodiment, it is contemplated that the elevator platform 240 can rotate within a single reciprocating 90° arc, or, alternatively, can continuously rotate, in 90° increments, in a complete circle to perform its offset function. Similarly, it is contemplated that the elevator platform 240 can be selectively rotated through 90° or 270° arcs so that outputs can be selectively rotated to left-facing, right-facing, upside-down or rightside-up orientations relative to the downstream direction.

With reference to FIG. 12, the controller 224 (not shown in FIG. 12) has directed the elevator platform 240 to remain in a lowered position, remote from the pivoting plate 294. The stacks 260, 262, 264 and 291 on the elevator platform 240 are, at this time, conveyed downstream off the elevator platform 240 by platform conveyor belts 242, as indicated by arrow 320, onto a discharge conveyor 322. The stacks 324 shown on the discharge conveyor 322 in FIG. 7 as detailed by arrow 328 in FIG. 8 have already moved downstream.

Once positioned on the discharge conveyor 322, the stacks 260, 262, 264 and 291 can be transferred to an off-loading point or can be transported to a downstream location for further processing. At this time, the empty elevator platform 240 is again moved upwardly to receive the next completed stack (not shown).

Figure 13:
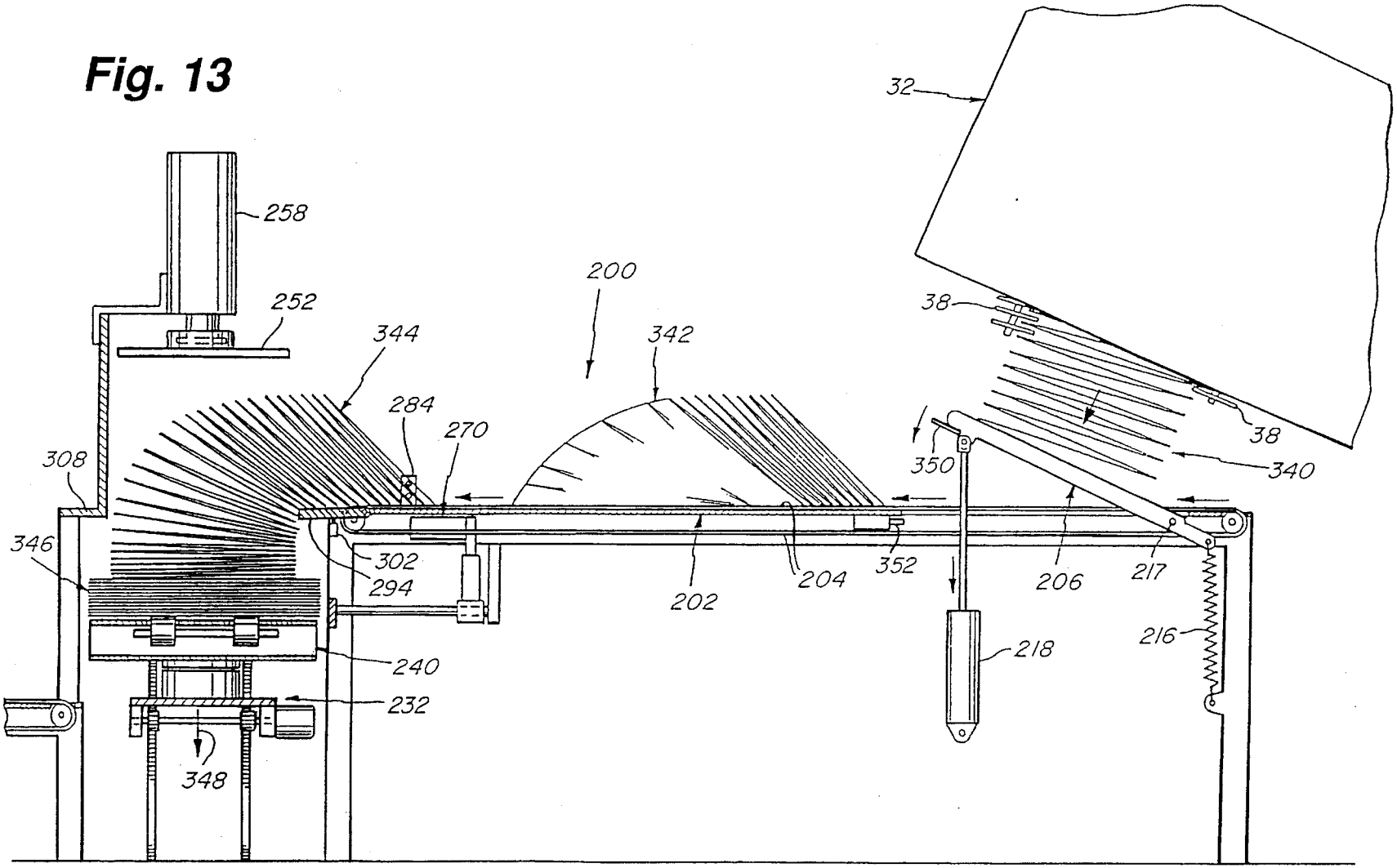
FIG. 13 is a somewhat schematic side view of an alternate embodiment of an offset stack-forming process utilizing a waterfall flow of folded sheets according to this invention.

FIGS. 7–12, described above, relate to the formation and transport of discrete stacks of folded web. As illustrated in FIG. 13, by moving the conveyor belts 204 at a desired speed, the stacks can be transferred to the elevator platform 240 in a "waterfall" configuration (i.e., a continuous flow of zig-zag folded web). This enables the transfer of taller stacks of folded web that may, otherwise, be too tall to clear the bottom of the folder and separator 32. As detailed in FIG. 13, a new stack 340 is output from the folder and separator 32 while an intermediate stack 344 is in the process of loading, in landscape configuration. The elevator platform 240 is slowly moving downwardly under direction of the controller (224) as detailed by the arrow 348. Note that the upstream-most stack 340 currently being formed has not yet driven the support assembly 206 downwardly onto the conveyor table 202. Hence, the newly formed stack is being compressed in its initial formation stage. As further detailed in FIG. 14, the upstreammost stack 340 has now become large enough so that its weight overcomes the spring 216 and drives the supports 206 into flush engagement with conveyor table 202. In this embodiment, it can be desirable to maintain the supports in flush engagement with The conveyor table 202 throughout the formation of the waterfall stack 340. Otherwise, the tail of the stack could be driven upwardly again by action of the spring 216 when the heavier downstream portion (which is generally more compressed) is driven by the belts 204 away from the support assembly 206. Thus, the supports according to this embodiment include a locking plate 350 that engage a movable latch 352 that can be brought into engagement with the plate 350 as shown by the arrow 354. The latch 352 can comprise an electromagnetic linear motor, solenoid or other form of actuator that is controlled by the controller 224 (not shown in FIG. 14). The latch 352 can also be used in conjunction with the linear actuator 218 where the compressing action of the support assembly is not desired.

Figure 14:
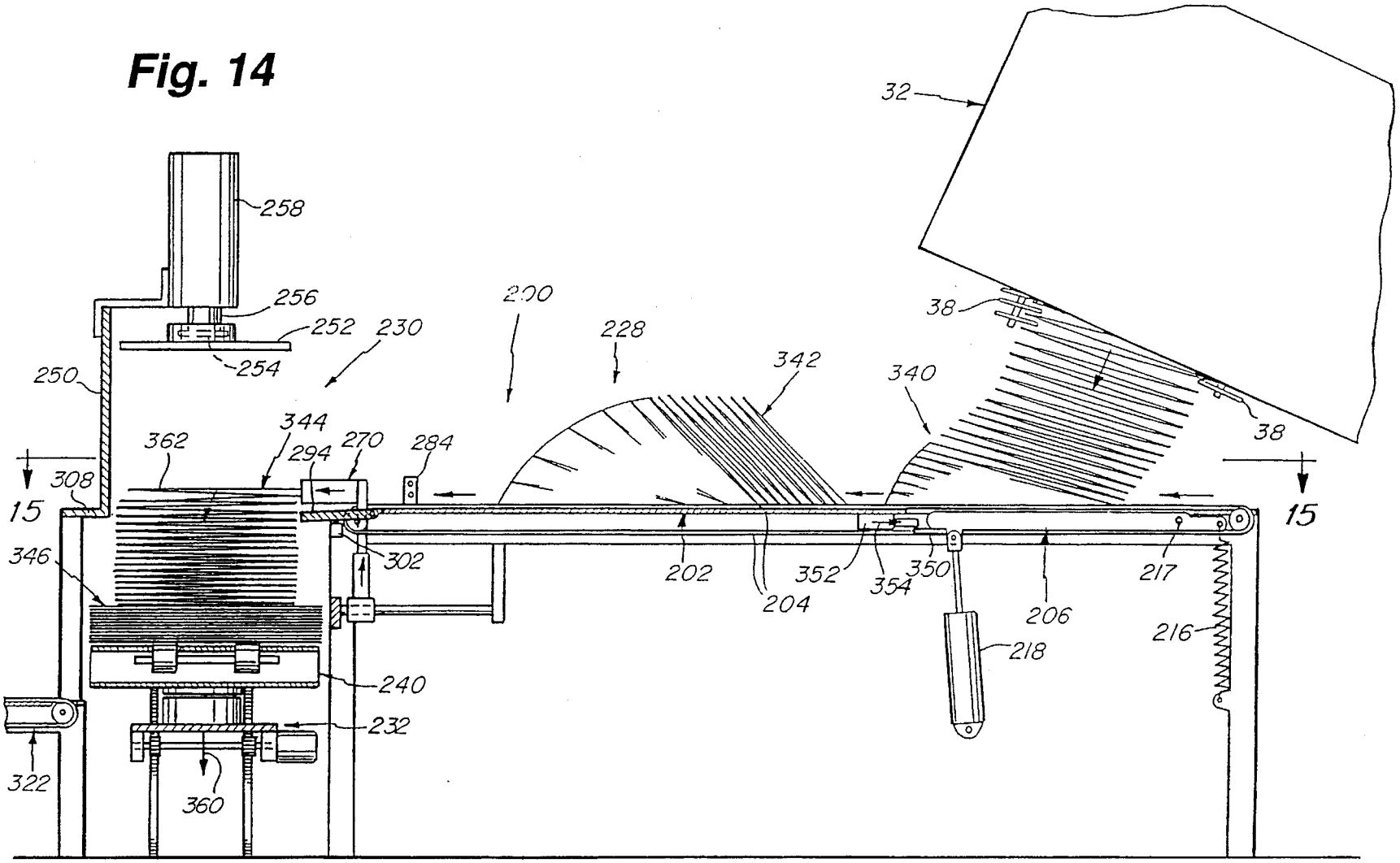
FIG. 14 is another step in the stack-forming process according to FIG. 13.

With further reference to FIG. 14, the upstream end of the stack 344 has now passed through the sensor 284 and, thus, the controller has signalled the pusher assembly to 70 to drive the trailing upstream end of the stack onto the top of the stack as it is located on the elevator platform 240 on top of a previously-completed stack 346. The controller then directs the elevator platform 240 to descend as shown by arrow 360 to place the top 362 of the stack 344 below the level of the pivoting plate 294. At some point during the descent of the elevator platform 240, the compression plate 252 is driven downwardly onto the top face 362 of the stack 344 to further compress it. As described above, once the stack 344 is clear of interfering contact with the pivoting plate 294, the elevator platform 240 is rotated 90° by the turntable drive 244 to place the stack 344 into a portrait configuration relative to the downstream direction. The elevator platform 240 is again moved upwardly until the stack causes the pivoting plate to trip the microswitch 302, signalling the elevator 232 to stop its upward ascent and directing the compression plate 252 to withdraw from the top face 352 of the stack. A new stack which, in this case, is stack 342, is then driven onto the top of the completed stack 344.

Figure 15:
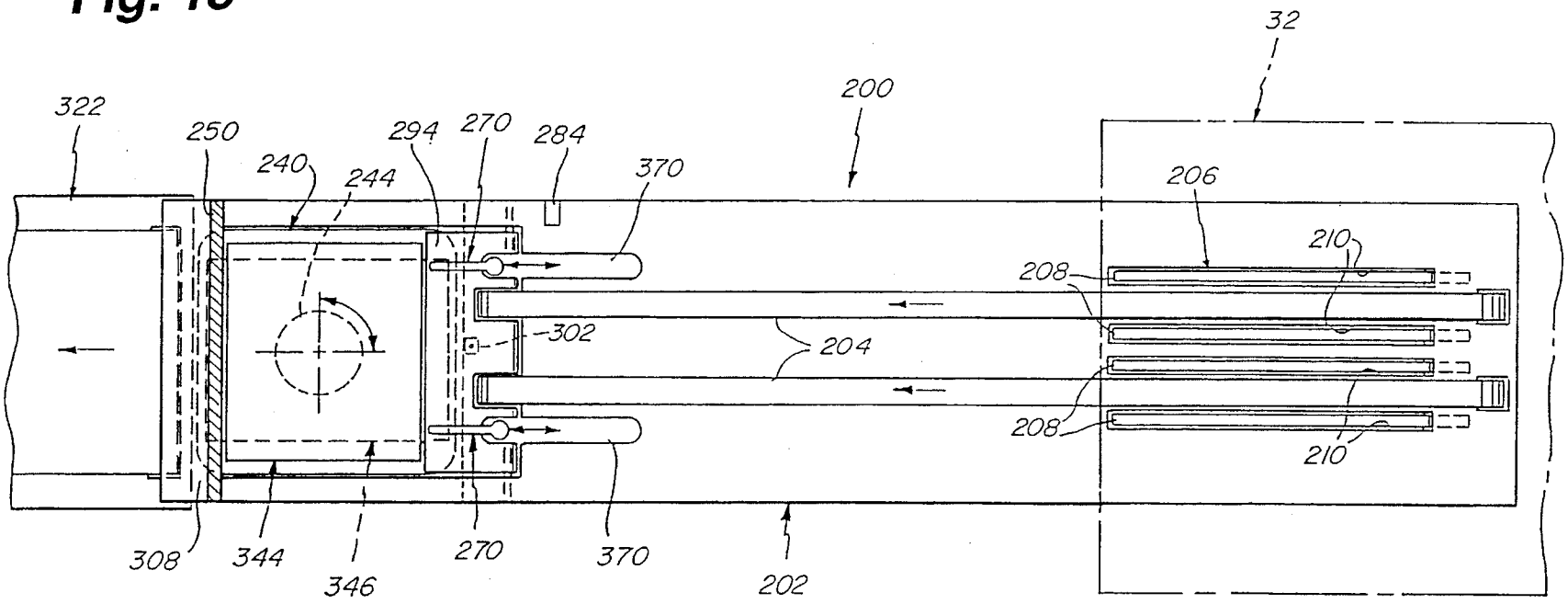
FIG. 15 is a plan view of the conveyor system taken along line 15—15 of FIG. 14.

With further reference to FIG. 15, a plan view of the conveyor 200 according to this embodiment is detailed. Slots 370 are provided to accommodate movement of the pushers 270 according to this embodiment. Additional pushers can be utilized according to this embodiment. They would, typically, be located between each of the conveyor belts. Note that additional conveyor belts can also be utilized. These would typically be located in a side-by-side relationship on the conveyor table 202. Alternatively, a series of moving rollers can be substituted for the conveyor belts with appropriate breaks in order to locate pushers and a moving support assembly. With reference to the preceding embodiment, described in FIGS. 1–6, the support assembly 206 in the illustrated embodiment (FIGS. 7–15) can be substituted with an elevator having a separate conveying surface thereon.

Figure 16:
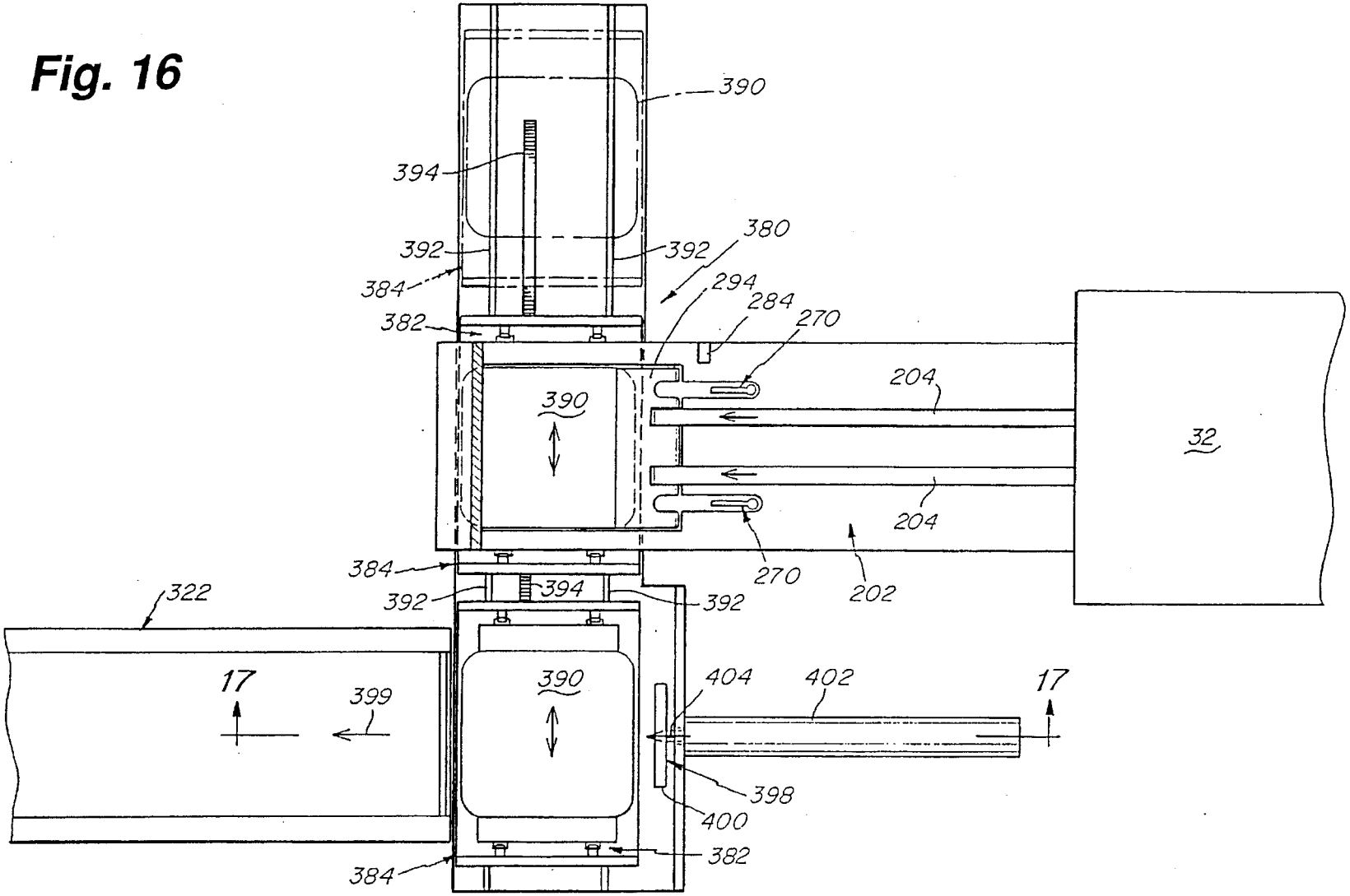
FIG. 16 is a plan view of an alternate embodiment of the conveyor system including a multi-position stacking elevator.
Figure 17:
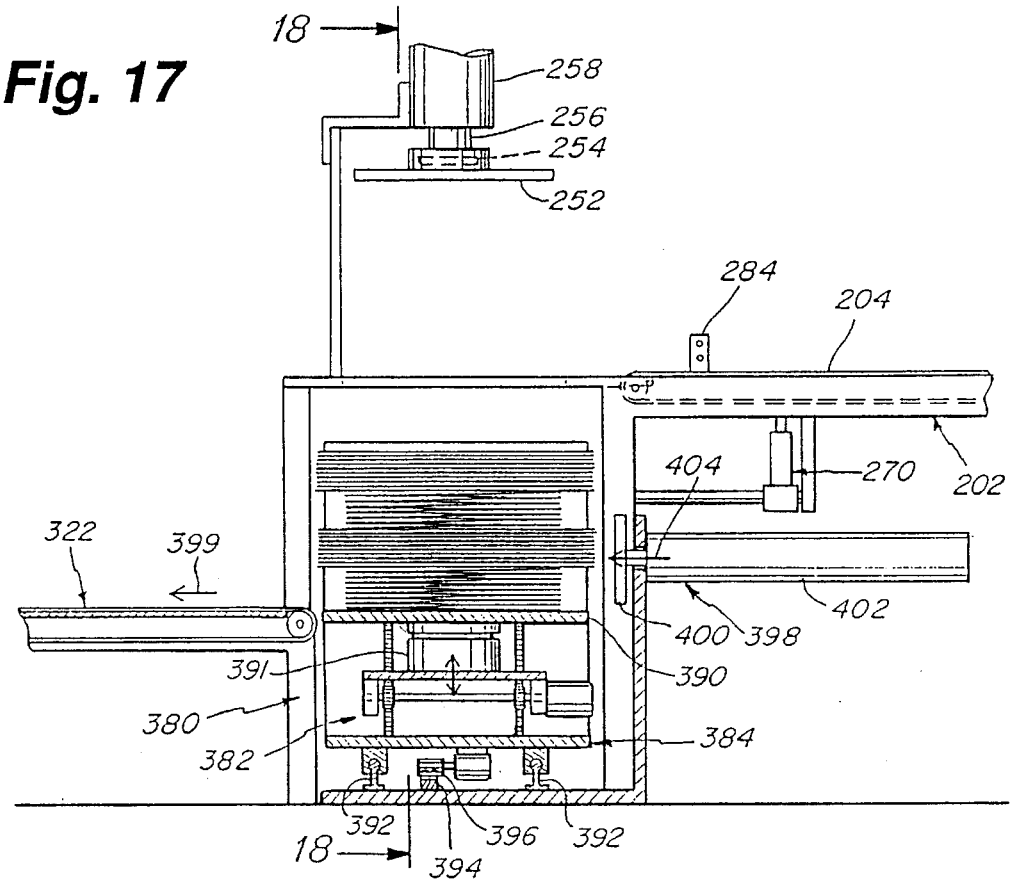
FIG. 17 is a partial cross-section of the stacking elevator taken along line 17—17 of FIG. 16.
Figure 18:
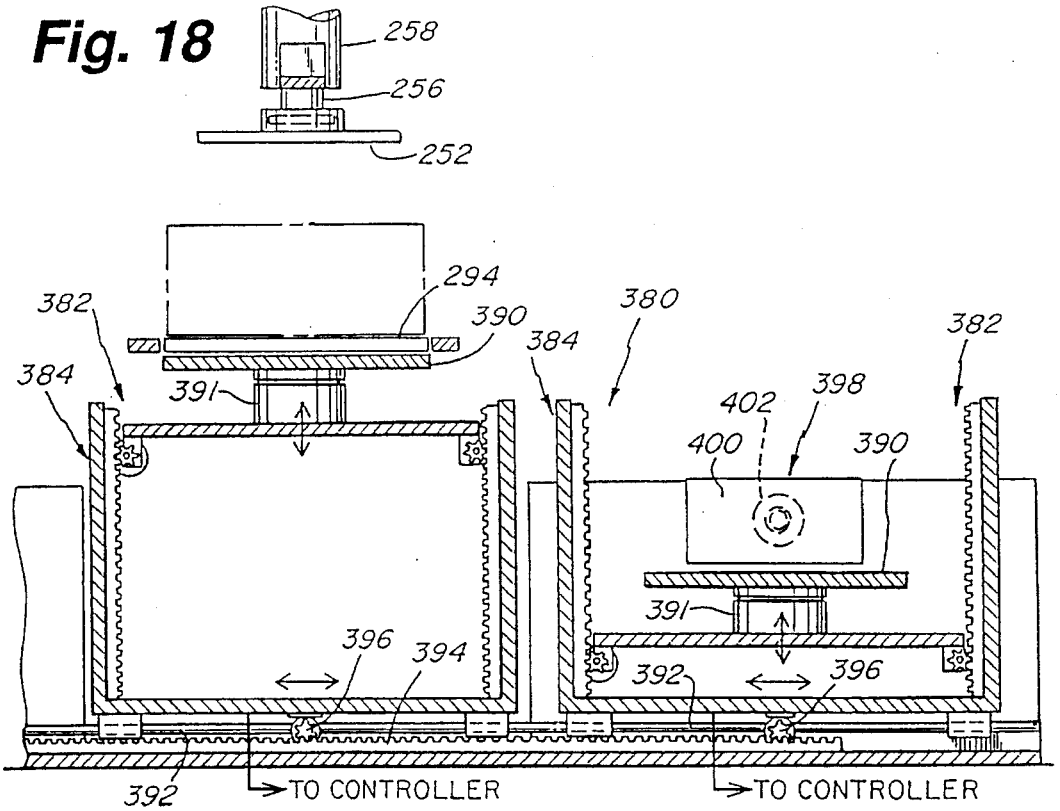
FIG. 18 is a partial cross-section of the stacking elevator taken along line 18—18 of FIG. 17.

FIGS. 16–18 detail a further option for use with the elevator platform according to the preceding embodiment (FIGS. 7–15). The elevator platform 380 in this embodiment comprises at least a pair of elevator drives 382 (FIG. 18). The elevator drives 382 are located in separate frameworks 384 having, in this embodiment, to enable the individual elevator platforms 390 to ascend and descend. The frameworks 384 are located on tracks 392 that allow their side-to-side movement, transverse to the downstream direction. In this embodiment, the tracks function in combination with a fixed gear rack 394 and pinion 396 located on each framework. The pinions rotate to drive the framework to move along the rack. Any suitable linear drive can be substituted for the rack and pinions provided herein.

The controller (not shown in FIGS. 16–18) positions a given framework within the delivery path of the conveyor table 202 in order to form a stack on the respective elevator platform 390 of that framework 384. Once the platform is filled to a desired level, the framework is moved out of the conveying path while the adjacent framework is moved into the path. Hence, continuous and uninterrupted loading and unloading of stacks can occur. The side-by-side conveyors detailed in FIGS. 16–18 can be used in conjunction with a discharge conveyor 322, or, alternatively, can act as a stand-alone unit in which a fully-loaded platform is moved to the side and unloaded while the adjacent platform is receiving further stacks from the conveyor table 202. The side-by-side elevator system according to this embodiment can still utilize the sensor 284 as described above as well as the pusher assembly 270 and compression plate 252.

As in the preceding embodiment (FIGS. 7–15) each elevator platform 390 of this embodiment includes a turntable drive 391 to enable rotational offset of successive stacks thereon. The offset function is accomplished in a manner like that of the preceding embodiment. To this end, the platform 390, when located in the conveying path, interacts with a pivoting plate 294 and microswitch (not shown) that interact with the controller. When a discharge conveyor 322 is utilized, the platforms 390 can include conveyor belts thereon. Alternatively, an external pusher 398 that, in this embodiment, can comprise a pusher plate 400 driven by a linear motor 402 can be utilized to transfer the completed stacks to conveyor 322 as indicated by the arrows 399 and 404.

Figure 19:
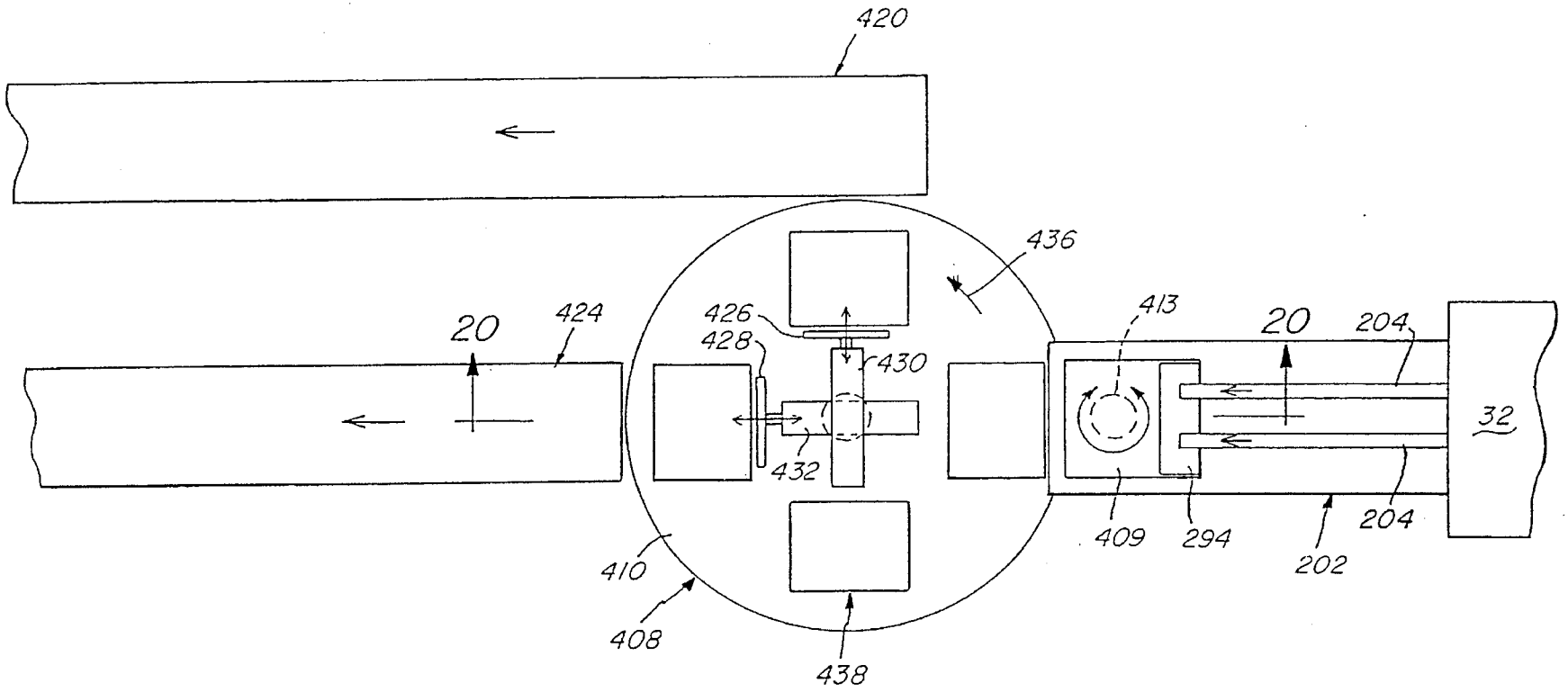
FIG. 19 is a schematic plan view of an alternate embodiment of the stacking elevator including a carousel for moving stacks to conveyor locations.
Figure 20:
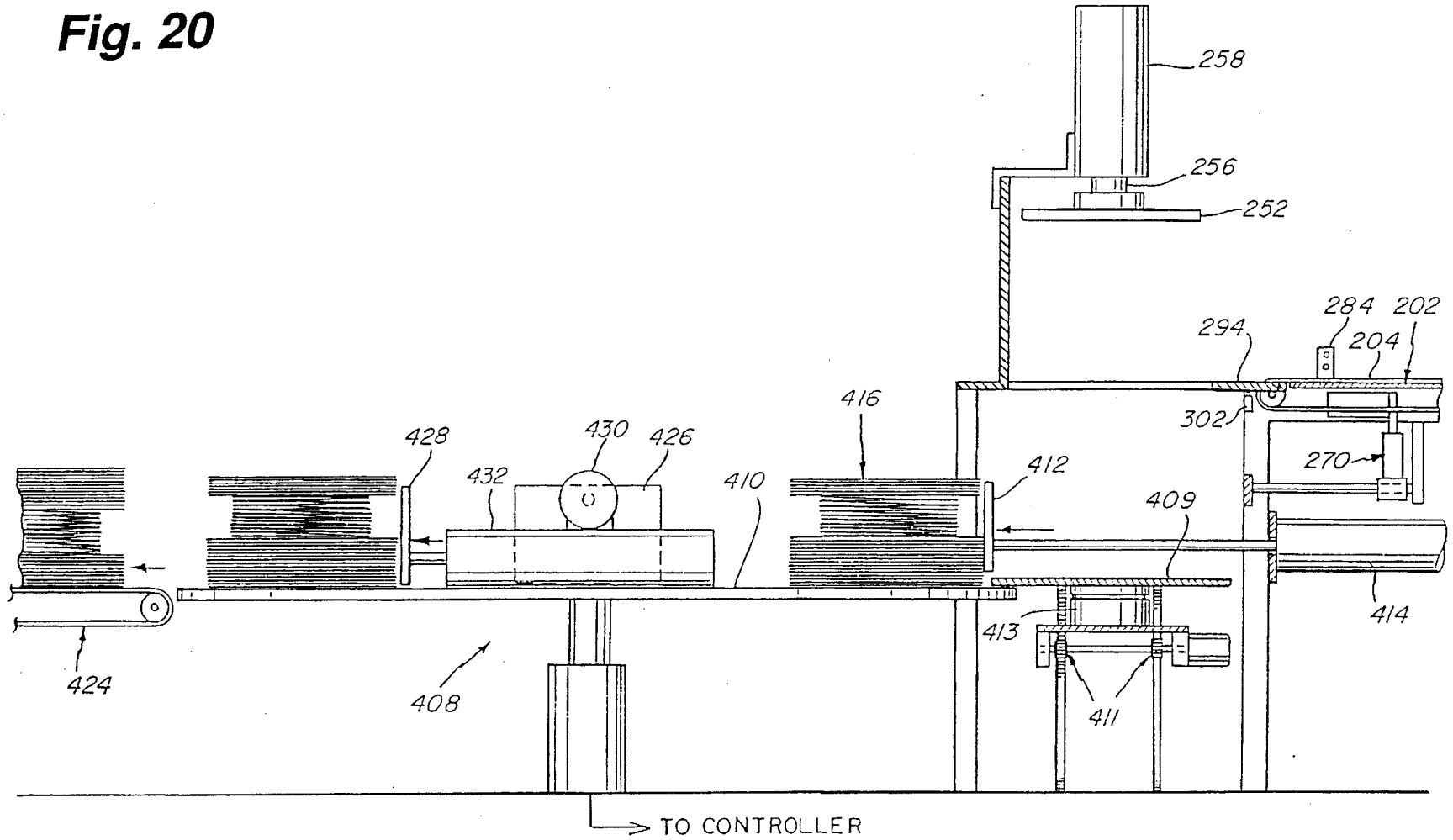
FIG. 20 is a cross-section of the stacking elevator taken along line 20—20 of FIG. 19.

FIGS. 19 and 20 illustrate another stack discharge unit for use with the conveyor system according to this embodiment. The conveyor table 202 according to this embodiment includes a single elevator platform 409 having a drive 411 to enable ascent and descent thereof. The platform 400 rotates, as described above, by means of a turntable drive 413 to enable offset of successive stacks thereon. It includes a compression plate 252 such as that described above as well as a sensor 284, pusher assembly 270, pivoting plate 294 and associated microswitch 302. Thus, the stacking and offsetting functions are like those of the preceding embodiments.

Downstream of the conveyor table 202, is located a carousel discharge system 408 according to this embodiment. As completed stacks are formed, the controller (not shown) directs the elevator platform 400 to descend into alignment with the table 410 of the carousel system plate then ejects a pusher plate 412, linear motor 414, and a completed stack 416 onto the carousel table 410 as shown in FIG. 20. The carousel table 410, in this embodiment, can be rotated from the conveyor table 202 to either a first discharge conveyor 420 or a second discharge conveyor 424 positioned to receive stacks from the carousel table 410 at 90° angles. Additional pusher plates 426 and 428 driven by corresponding, respective, linear motors 430 and 432 drive the stacks off the carousel table 410 onto the respective discharge conveyors 420 and 424. Alternatively, a stack can be driven through a 270° rotation (note arrow 436 in FIG. 19) to a free position 438 in which the stack can be inspected or manually unloaded according to this embodiment. Alternatively, an additional discharge conveyor can be provided at this location.

The use of multiple discharge conveyors allows more versatile post-processing operations to be performed on a given output. For example, one discharge conveyor can be interconnected directly with a packing device, while the other discharge conveyor can be interconnected with further post-processing devices. Similarly, the discharge conveyors can be located so that output is received by different end users upon command.

All of the above processes can be triggered by the controller 224 of FIG. 7 which can, itself, receive its instructions from a program entered by the user or, alternatively, from instructions printed upon the output web itself and read by the folder and separator or another web processing unit.

The foregoing has been a detailed description of preferred embodiments. Various modifications and additions can be made without departing from the spirit and scope of this invention. For example, the elevator platform used for receiving web from the upstream conveyor can comprise a substantially stationary platform and, conversely, the upstream conveyor table can be constructed to ascend and descend relative to the downstream receiving platform. Accordingly, this description is meant to be taken only by way of example and not to otherwise limit the scope of the invention.

What is claimed is:

1. A conveying system comprising:

a conveyor for receiving a stack of output folded web, the conveyor driving the web from an upstream end to a downstream end;

a supporting surface that moves between a position aligned with the conveyor for movement of the web downstream by the conveyor, to a position remote from the conveyor wherein folded web is deposited on the supporting surface free of downstream conveyance; and a means for sensing when a desired volume of web, based upon a predetermined compression of the web, is deposited on the supporting surface to move the supporting surface from the position remote from the conveyor to the position aligned with the conveyor for movement of the folded web to the downstream location by the conveyor.

2. The conveying system as set forth in claim 1, further comprising a folder and separator located adjacent the supporting surface, the folded web being deposited by the folder and separator on the supporting surface.

3. A conveying system comprising:

a conveyor for receiving a stack of output web from a web source, the conveyor driving the web from an upstream end, adjacent the web source to a downstream end;

a supporting surface, adjacent the web source, constructed and arranged to support a web exiting the web source remote from the conveyor for a selected duration so that a selected volume of web, based upon a predetermined compression of sheets in the stack, is formed on the supporting surface free of contact with the conveyor; and a drive member for moving the supporting surface between the position remote from the conveyor and a position in communication with the conveyor so that web on the supporting surface can be conveyed downstream by the conveyor.

4. The conveying system as set forth in claim 3 further comprising a retractable pusher, located at the downstream end of the conveyor, for driving at least an upstream trailing portion of the stack of web off of a downstream end of the conveyor.

5. The conveying system as set forth in claim 4 further comprising an elevator platform located at a downstream end of the conveyor for receiving the stack of web.

6. The conveying system as set forth in claim 5 further comprising a sensor located at the downstream end of the conveyor for sensing passage of the stack of web therethrough, constructed and arranged to thereby direct the pusher to bias the stack downstream off the conveyor.

7. A conveying system comprising:

a conveyor for receiving a stack of output folded web from web folder and separator, the conveyor driving the web from an end, adjacent the web folder and separator, to a downstream end;

a supporting surface, adjacent the web folder and separator, that supports a web exiting the web folder and separator remote from the conveyor for a selected period of time so that a selected volume of web is formed on the supporting surface free of contact with the conveyor;

a drive member for moving the supporting surface between the position remote from the conveyor and a position in communication with the conveyor so that web on the supporting surface can be conveyed downstream by the conveyor; and wherein the supporting surface comprises at least one pivoting rail located with respect to a recess in the conveyor that receives the rail when the rail is in communication with the conveyor, the rail extending pivotably out of the slot toward the folder and separator at selected times to support web output from the folder and separator remote from the conveyor.

8. The conveying system as set forth in claim 7 wherein the pivoting rail includes a spring that biases the rail toward the conveyor separator, a biasing force of the spring being overcome by a stack on the rail having a selected weight.

9. The conveying system as set forth in claim 8 further comprising a retractable pusher assembly located at the downstream end of the conveyor for driving at least a trailing portion of a stack of folded web off of the conveyor.

10. The conveying system as set forth in claim 9 further comprising a sensor located at the downstream end of the conveyor for sensing passage of a stack of web therethrough thereby directing the pusher to bias the stack downstream off of the conveyor.

11. The conveying system as set forth in claim 10 further comprising an elevator platform located at the downstream end of the conveyor for receiving the stack of folded web thereon.

12. The conveying system as set forth in claim 11 wherein the sensor is constructed and arranged to cause the elevator platform to descend in response to the passage of an upstream end of the stack of folded web therethrough.

13. The conveying system as set forth in claim 12 wherein the elevator platform further includes a rotary drive that causes the elevator platform to rotate on an axis substantially transverse to a downstream direction of folded web movement so that stacks of folded web received on the elevator platform can be rotated to selected rotational orientations relative to the downstream direction.

14. The conveying system as set forth in claim 13 wherein the downstream end of the conveyor includes a pivoting plate that engages an edge of a stack of folded web located on the elevator platform in one rotational orientation and that is free of engagement with the edge of the stack in another rotational orientation.

15. The conveying system as set forth in claim 14 wherein the pivoting plate includes a plate sensor, wherein engagement of the edge of the stack in the one rotational orientation with the pivoting plate ceases an ascent of the elevator platform.

16. The conveying system as set forth in claim 15 further comprising a compression plate that compresses the stack of folded web on the elevator platform at selected times.

17. The conveying system as set forth in claim 16 wherein the compression plate compresses the stack in response to the passage of the stack of folded web through the sensor.

18. The conveying system as set forth in claim 17 wherein the compression plate includes a bearing, wherein the compression plate rotates in conjunction with a rotation about the axis of the elevator platform.

19. The conveying system as set forth in claim 18 wherein the elevator platform includes a discharge mechanism to transport the stack of folded web from the elevator platform at a selected time.

20. The conveying system as set forth in claim 19 further comprising a discharge conveyor, located downstream of the elevator platform for receiving the stack of folded web discharged from the elevator platform.

21. The conveying system as set forth in claim 20 further comprising a plurality of elevator platforms that are each selectively movable into a position to receive a stack of folded web from the conveyor.

22. The conveying system as set forth in claim 19 further comprising a rotating discharge carousel for receiving a stack of folded web discharged from the elevator platform, the carousel movable to locate the stack adjacent each of a plurality of positions.

23. The conveying system as set forth in claim 22 wherein at least some of the plurality of positions include discharge conveyors and wherein the carousel includes a discharge mechanism for moving the stack onto a selected of the discharge conveyors.

24. The conveying system as set forth in claim 23 wherein the carousel comprises a substantially circular table that rotates on an axis.

25. A conveying system comprising;

a conveyor for receiving a stack of output folded web, the conveyor driving the web from an upstream end to a downstream end;

a supporting surface that moves between a position aligned with the conveyor for movement of the web downstream by the conveyor, to a position remote from the conveyor wherein folded web is deposited on the supporting surface free of downstream conveyance;

a means for sensing when a desired volume of web is deposited on the supporting surface to move the supporting surface from the position remote from the conveyor to the position aligned with the conveyor for movement of the folded web to the downstream location by the conveyor; and wherein the means for sensing includes a spring that biases the supporting surface to the position remote from the conveyor, the spring being overcome by a predetermined weight of folded web located on the supporting surface.

26. A conveying system comprising:

a conveyor for receiving a stack of output folded web from a web folder and separator, the conveyor driving the web from an upstream end, adjacent the web folder and separator, to a downstream end;

a supporting surface, adjacent the web folder and separator, that supports a web exiting the web folder and separator remote from the conveyor for a selected period of time so that a selected volume of web is formed on the supporting surface free of contact with the conveyor, the selected volume of web being based upon a predetermined compression of folded web; and a drive member for moving the supporting surface between the position remote from the conveyor and a position in communication with the conveyor so that web on the supporting surface can be conveyed downstream by the conveyor.

27. A conveying system comprising;

a conveyor for directing web from a folder and separator to a downstream location;

an elevator platform located at the downstream location for receiving the folded web from the conveyor, the elevator platform selectively ascending and descending relative to the conveyor;

a drive for rotating the elevator platform on an axis that is substantially transverse to the downstream direction wherein successive stacks of folded web deposited on the elevator platform can be rotationally offset relative to each other; and a retractable pusher that extends through the conveyor, into a path of travel of the folded web at selected times to drive an upstream end of the folded web off of the downstream end of the conveyor and onto the elevator platform.

28. The conveying system as set forth in claim 27 further comprising a supporting surface, adjacent the folder and separator for supporting a web output from the folder and separator above the conveyor.

29. The conveying system as set forth in claim 27 further comprising a discharge conveyor located downstream of the elevator platform, the elevator platform being movable so that it can be positioned in communication with the discharge conveyor to transfer a stack of folded web onto the discharge conveyor.

30. A conveying system comprising:

a conveyor for directing web from a folder and separator to a downstream location;

an elevator platform located at the downstream location for receiving the folded web from the conveyor, the elevator platform selectively ascending and descending relative to the conveyor:

a drive for rotating the elevator platform on an axis that is substantially transverse to the downstream direction wherein successive stacks of folded web deposited on the elevator platform can be rotationally offset relative to each other:

a discharge conveyor located downstream of the elevator platform, the elevator platform being movable so that it can be positioned in communication with the discharge conveyor to transfer a stack of folded web onto the discharge conveyor; and wherein the elevator platform includes a conveyor for transferring the stack of folded web onto the discharge conveyor.

31. The conveying system as set forth in claim 27 further comprising a compression plate located over the elevator platform for compressing a stack of folded web located thereon.

32. A conveying system comprising:

a conveyor for receiving a stack of output folded web from a web folder and separator, the conveyor driving the web from an end, adjacent the web folder and separator, to a downstream end;

a supporting surface adjacent the web folder and separator, that supports a web exiting the web folder and separator remote from the conveyor for a selected period of time so that a selected volume of web is formed on the supporting surface free of contact with the conveyor;

a drive member for moving the supporting surface between the position remote from the conveyor and a position in communication with the conveyor so that web on the supporting surface can be conveyed downstream by the conveyor; and a retractable pusher, located at the downstream end of the conveyor, for driving at least an upstream trailing protion of a folded web off the downstream end of the conveyor.

33. The conveying system as set forth in claim 32 further comprising an elevator platform located at a downstream end of the conveyor for receiving the folded web in a stack.

34. The conveying system as set forth in claim 33 wherein the supporting surface is constructed and arranged to remain in engagement with the conveyor subsequent to formation of a stack of a desired size and wherein the conveyor is operated continuously to direct a waterfall configuration of the folded web from the folder and separator in a downstream direction.

35. The conveying system as set forth in claim 34 wherein the supporting surface comprises an elevator platform having a conveyor drive thereon, the conveyor drive selectively directing web downstream onto a second conveyor.

36. The conveying system as set forth in claim 26 further comprising a sensor located at the downstream end of the conveyor for sensing passage of a stack of web therethrough, constructed and arranged to thereby direct the pusher to bias the stack downstream off of the conveyor.

37. A conveying system comprising a conveyor for receiving a stack of output folded web, the conveyor driving the web from an upstream end to a downstream end;

a supporting surface that moves between a position aligned with the conveyor for movement of the web downstream by the conveyor, to a position remote from the conveyor wherein folded web is deposited on the supporting surface free of downstream conveyance;

a means for sensing when a desired volume of web is deposited on the supporting surface to move the supporting surface from the position remote from the conveyor to the position aligned with the conveyor for movement of the folded web to the downstream location by the conveyor; and an elevator platform positioned at the downstream end of the conveyor, the elevator platform including a turntable drive for rotating a web received from the conveyor by the elevator platform to a desired rotational orientation.

38. A conveying system comprising:

a conveyor for receiving a stack of output folded web, the conveyor driving the web from an upstream end to a downstream end;

a supporting surface that moves between a position aligned with the conveyor for movement of the web downstream by the conveyor, to a position remote from the conveyor wherein folded web is deposited on the supporting surface free of downstream conveyance;

a means for sensing when a desired volume of web is deposited on the supporting surface to move the supporting surface from the position remote from the conveyor to the position aligned with the conveyor for movement of the folded web to the downstream location by the conveyor; and a locking mechanism for locking the supporting surface in the position aligned with the conveyor so that web is received for direct conveyance in the downstream direction by the conveyor.

39. A conveying system comprising:

a conveyor for receiving a stack of output folded web, the conveyor driving the web from an upstream end to a downstream end;

a platform located at the downstream end, the platform receiving the folded web from the conveyor, the platform including an elevator drive for raising and lowering the platform relative to the conveyor so that stacks having a plurality of thicknesses can be received by the platform;

a turntable drive interconnected with the platform to rotate the platform relative to a downstream direction so that the folded web received by the platform is positionable in a plurality of desired rotational orientations:

a sensor that senses passage of the folded web onto the platform, the sensor signaling the elevator drive to lower the platform in response to the passage therethrough; and a pusher mechanism that biases a tail end of the folded web onto the platform in response to passage of the folded web through the sensor.

40. A conveying system comprising:

a conveyor for receiving a stack of output folded web, the conveyor driving the web from an upstream end to a downstream end:

a platform located at the downstream end, the platform receiving the folded web from the conveyor the platform including an elevator drive for raising and lowering the platform relative to the conveyor so that stacks having a plurality of thicknesses can be received by the platform;

a turntable drive interconnected with the platform to rotate the platform relative to a downstream direction so that the folded web received by the platform is positionable in a plurality of desired rotational orientations: and a pivoting plate having a plate sensor attached thereto, the pivoting plate being engaged by an edge of the folded web in at least one rotational orientation and being free of engagement with the web in at least another rotational orientation, wherein engagement of the pivoting plate by the edge instructs the elevator drive to cease raising movement.

41. A method for conveying a folded web comprising:

outputting web from a folder;

conveying the outputted web to a downstream location;

supporting the folded web, adjacent the folder, so that the web is free of conveying at selected times;

locating the folded web output by the folder so that the folded web is conveyed to the downstream location; and forming the web into discrete stacks at the downstream location including locating successive stacks of folded web at the downstream location and further including lowering a supporting surface so that a top of each of the successive stacks is located to receive an additional stack of folded web thereon.

42. A method as set forth in claim 41 further comprising applying compression force to each of the successive stacks at the downstream location to reduce air space between folded pages therein.

43. A method as set forth in claim 41 further comprising rotating the successive stacks so that a further stack delivered by the step of conveying is positioned at a rotational offset relative to the successive stacks.

44. A method for conveying a folded web comprising:

outputting web from a folder;

conveying the outputted web to a downstream location;

supporting the folded web, adjacent the folder, so that the web is free of conveying at selected times;

locating the folded web output by the folder so that the folded web is conveyed to the downstream location; and applying an auxiliary driving force, adjacent the downstream location, to an upstream trailing end of the web, to drive the upstream trailing end of the web into the downstream location.

45. A conveying system comprising:

a conveyor for directing a stack of web from an upstream location to a downstream location;

an elevator platform located at the downstream location for receiving the folded web from the conveyor, the elevator platform selectively ascending and descending relative to the conveyor; and a drive for rotating the elevator platform on an axis that is substantially transverse to the downstream direction, wherein successive stacks of folded web deposited on the elevator platform can be rotationally offset relative to each other.

46. The conveying system as set forth in claim 45 further comprising a retractable pusher that extends through the conveyor, into a path of travel of the folded web at selected times to drive an upstream end of the folded web off of the downstream end of the conveyor and onto the elevator platform.

47. The conveying system as set forth in claim 45 further comprising a discharge conveyor located downstream of the elevator platform, the elevator platform being movable so that it can be positioned in communication with the discharge conveyor to transfer a stack of folded web onto the discharge conveyor.

48. The conveying system as set forth in claim 45 further comprising a compression plate located over the elevator platform for compressing a stack of folded web located thereon.

49. The conveying system as set forth in claim 47 wherein the elevator platform further includes a rotary drive constructed and arranged to that cause the elevator platform to rotate on an axis substantially transverse to a downstream direction of web movement so that each of the stacks of web received on the elevator platform can be rotated to selected rotational orientations relative to the downstream direction.

50. The conveying system as set forth in claim 49 wherein the downstream end of the conveyor includes a pivoting plate that engages an edge of the stack of web located on the elevator platform in one rotational orientation and that is free of engagement with the edge of the stack in another rotational orientation.

51. The conveying system as set forth in claim 50 wherein the pivoting plate includes a plate sensor, wherein an engagement of the edge of the stack in the one rotational orientation with the pivoting plate ceases an ascent of the elevator platform.

* * * * *

UNITED STATES PATENT AND TRADEMARK OFFICE

CERTIFICATE OF CORRECTION

PATENT NO. : 5,558,318

DATED : September 24, 1996

INVENTOR(S) : H.W. Crowley

It is certified that error appears in the above-identified patent and that said Letters Patent is hereby corrected as shown below:

Claim 32, column 17, line 26, change "protion" to —portion—.

Signed and Sealed this

Eighth Day of April, 1997

*Attest:*

*Attesting Officer*

BRUCE LEHMAN

*Commissioner of Patents and Trademarks*